US009886881B2

(12) United States Patent
Zhang et al.

(10) Patent No.: US 9,886,881 B2
(45) Date of Patent: Feb. 6, 2018

(54) METHOD AND DEVICE FOR IMAGE CONVERSION FROM RGB SIGNALS INTO RGBW SIGNALS

(71) Applicant: BOE TECHNOLOGY GROUP CO., LTD., Beijing (CN)

(72) Inventors: Chen Zhang, Beijing (CN); Fei Yang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 72 days.

(21) Appl. No.: 14/770,916

(22) PCT Filed: Sep. 26, 2014

(86) PCT No.: PCT/CN2014/087588
§ 371 (c)(1),
(2) Date: Aug. 27, 2015

(87) PCT Pub. No.: WO2015/196608
PCT Pub. Date: Dec. 30, 2015

(65) Prior Publication Data

US 2016/0293082 A1 Oct. 6, 2016

(30) Foreign Application Priority Data

Jun. 25, 2014 (CN) ..... 2014 1 0291286

(51) Int. Cl.
*G09G 3/36* (2006.01)
*G09G 3/20* (2006.01)
*G09G 5/02* (2006.01)

(52) U.S. Cl.
CPC ..... *G09G 3/2003* (2013.01); *G09G 5/02* (2013.01); *G09G 2340/06* (2013.01)

(58) Field of Classification Search
CPC ..... G09G 3/2003; G09G 3/36; G09G 3/3607; G09G 3/3625; G09G 3/3648
(Continued)

(56) References Cited

U.S. PATENT DOCUMENTS 7,808,462 B2 * 10/2010 Tanase ..... G09G 3/2003 345/600
8,896,641 B2 11/2014 Kim et al.
(Continued)

FOREIGN PATENT DOCUMENTS

CN 1713256 A 12/2005
CN 101419771 A 4/2009
(Continued)

OTHER PUBLICATIONS

Notification to Grant the Patent Right (Notice of Allowance) for Chinese Patent Application Serial No. 201410291286.3 dated Feb. 2, 2016 in Chinese with an English translation.
(Continued)

*Primary Examiner* — Alexander Eisen
*Assistant Examiner* — Nelson Lam
(74) *Attorney, Agent, or Firm* — Collard & Roe, P.C.

(57) ABSTRACT

A method and device for image conversion from RGB signals into RGBW signals, after converting the RGB luminance input values into RGBW luminance output values, determine color-cast-removed RGBW luminance output values respectively, according to a position relationship between RGBW color coordinate values to which the RGBW luminance output values correspond respectively and a predetermined actual color coordinate value of a color having monochromatic color cast among RGBW in a chromaticity diagram, and thereafter convert the color-cast-removed RGBW luminance output values into corresponding RGBW output signals respectively and output the same.
(Continued)

By means of the above method provided in the present disclosure, color having monochromatic shifting among RGBW can be compensated back to the expected RGBW color coordinates and luminance values, so the problems of color gamut deviation and color distortion caused by RGBW monochromatic color cast are eliminated, color gamut of the displayed image is more accurate.

16 Claims, 6 Drawing Sheets

(58) Field of Classification Search
USPC ..... 345/87–104
See application file for complete search history.

(56) References Cited

U.S. PATENT DOCUMENTS

| | | | | |
|---|---|---|---|---|
| 9,317,939 | B2 * | 4/2016 | Yang | G06T 11/001 |
| 9,666,115 | B2 * | 5/2017 | Zhang | G09G 3/2003 |
| 9,666,162 | B2 * | 5/2017 | Yang | G09G 5/02 |
| 2005/0285828 | A1 | 12/2005 | Inoue et al. | |
| 2006/0139527 | A1 * | 6/2006 | Chang | G02F 1/133514 349/114 |
| 2006/0146351 | A1 * | 7/2006 | Lo | G09G 3/3607 358/1.9 |
| 2006/0214942 | A1 * | 9/2006 | Tanase | G09G 3/2003 345/589 |
| 2006/0268003 | A1 * | 11/2006 | Tanase | G09G 3/2003 345/603 |
| 2009/0102769 | A1 * | 4/2009 | Kouno | G09G 3/3648 345/88 |
| 2009/0262148 | A1 * | 10/2009 | Kimura | G09G 3/2003 345/690 |
| 2010/0245381 | A1 | 9/2010 | Samadani et al. | |
| 2012/0268353 | A1 * | 10/2012 | Mizukoshi | G09G 3/2003 345/76 |
| 2014/0035798 | A1 * | 2/2014 | Kawada | G09G 3/3208 345/77 |
| 2015/0154762 | A1 * | 6/2015 | Yang | H04N 9/67 345/603 |
| 2016/0253942 | A1 * | 9/2016 | Tseng | G06T 11/001 345/601 |
| 2017/0256190 | A1 * | 9/2017 | Jin | G09G 3/2003 |

FOREIGN PATENT DOCUMENTS

| | | | |
|---|---|---|---|
| CN | 101894541 | A | 11/2010 |
| CN | 102810293 | A | 12/2012 |
| CN | 103218988 | A | 7/2013 |
| CN | 103747223 | A | 4/2014 |
| CN | 104091578 | B | 3/2016 |
| KR | 10-2013-0030598 | A | 3/2013 |
| KR | 10-2013-0036676 | A | 4/2013 |
| WO | 2015/196608 | A1 | 12/2015 |

OTHER PUBLICATIONS

Granted Claims for Chinese Patent CN 104091578 B (Chinese Patent Application Serial No. 201410291286.3 ) with an English translation.
International Search Report of PCT/CN2014/087588 in Chinese, dated Apr. 9, 2015 with English translation.
Notice of Transmittal of the International Search Report of PCT/CN2014/087588 in Chinese, dated Apr. 13, 2015.
Written Opinion of the International Searching Authority of PCT/CN2014/087588 in Chinese, dated Apr. 9, 2015 with English translation.
Chinese Office Action of Chinese Application No. 201410291286.3, dated Oct. 10, 2015 with English translation.
Extended European Search Report in EP 14882165.5 dated Dec. 14, 2017.

* cited by examiner

METHOD AND DEVICE FOR IMAGE CONVERSION FROM RGB SIGNALS INTO RGBW SIGNALS

TECHNICAL FIELD

The present disclosure relates to the field of display technique, and more particularly, to a method and a device for image conversion from RGB signals into RGBW signals.

BACKGROUND

At present, in an image display device such as a Liquid Crystal Display panel and an Organic electroluminescence Light-Emitting Diode display panel, a pixel unit comprises a Red (R) sub-pixel unit, a Green (G) sub-pixel unit and a Blue (B) sub-pixel unit, and a color image is displayed by controlling the grayscale values of respective sub-pixel units to be blended together to obtain a color as needed to be displayed. Since luminous efficiency of RGB primary colors is relatively low, optimization of the display device being constructed by the RGB primary colors is constrained. In view of the above, a pixel unit comprising a Red (R) sub-pixel unit, a Green (G) sub-pixel unit, a Blue (B) sub-pixel unit and a White (W) sub-pixel unit is developed to improve the luminous efficiency of a RGB display.

Currently, in a conversion from RGB signals into RGBW signals, many reasons can cause shifting of four colors R, G, B, W, which may result in that an actual color gamut is different than a color gamut expected at design, and cause problems of color gamut lose and color distortion. Therefore, how to improve accuracy of color gamut in a conversion from RGB signals into RGBW signals is a technical problem that those skilled in the art need to solve urgently.

SUMMARY

In view of the above, embodiments of the present disclosure provide a method and a device for image conversion from RGB signals into RGBW signals, to solve the problems of color gamut deviation and color distortion caused by shifting of four colors R, G, B, W.

Accordingly, an embodiment of the present disclosure provides a method for image conversion from RGB signals into RGBW signals, comprising:

converting received RGB input signals as into RGB luminance input values, respectively;

converting the RGB luminance input values into RGBW luminance output values;

determining color-cast-removed RGBW luminance output values respectively, according to a position relationship between RGBW color coordinate values to which the RGBW luminance output values correspond respectively and a predetermined actual color coordinate value of a color having monochromatic color cast among RGBW in a chromaticity diagram;

converting the color-cast-removed RGBW luminance output values into corresponding RGBW output signals respectively and outputting the same.

The above method for image conversion from RGB signals into RGBW signals provided in the embodiment of the present disclosure, after converting the RGB luminance input values into RGBW luminance output values, determines color-cast-removed RGBW luminance output values respectively, according to the position relationship between RGBW color coordinate values to which the RGBW luminance output values correspond respectively and the predetermined actual color coordinate value of the color having monochromatic color cast among RGBW in the chromaticity diagram, and thereafter converts the color-cast-removed RGBW luminance output values into corresponding RGBW output signals and outputs the same, respectively. By means of the above method provided in the present disclosure, a color having monochromatic shifting among RGBW can be compensated back to the expected RGBW color coordinates and luminance values, thus the problems of color gamut deviation and color distortion caused by RGBW monochromatic color cast are eliminated, color gamut of the displayed image is more accurate. Meanwhile, in the process of removing color cast, numerical values of the RGBW luminance output values can be adjusted as needed to improve luminance of a display device in entirety, thus improving picture contrast.

In a possible implementation, in the above method provided in the embodiment of the present disclosure, determining color-cast-removed RGBW luminance output values respectively, according to the position relationship between RGBW color coordinate values to which the RGBW luminance output values correspond respectively and the predetermined actual color coordinate value of the color having monochromatic color cast among RGBW in the chromaticity diagram further comprises:

when it is determined that the color having monochromatic color cast among RGBW is W, determining, in the chromaticity diagram, RGBW color coordinate values to which the RGBW luminance output values correspond respectively and a W actual color coordinate value;

determining, in the chromaticity diagram, position relationship between the W actual color coordinate value and a first region, a second region, a third region, according to the RGBW color coordinate values and the W actual color coordinate value; the first region being a region divided by an intersection between BG and an extension line from R to W, an intersection between RG and an extension line from B to W, and W and G; the second region being a region divided by an intersection between BR and an extension line from G to W, an intersection between BG and an extension line from R to W, and W and B; the third region being a region divided by an intersection between RG and an extension line from B to W, an intersection between RB and an extension line from G to W, and W and R;

determining color-cast-removed RGBW luminance output values respectively, according to the determined position relationship, a preset luminance adjustment coefficient, the W actual color coordinate value, RGBW color coordinate values and a W luminance output value.

In a possible implementation, in the above method provided in the embodiment of the present disclosure, determining color-cast-removed RGBW luminance output values respectively, according to the determined position relationship, the preset luminance adjustment coefficient, the W actual color coordinate value, RGBW color coordinate values and the W luminance output value further comprises:

when it is determined that the W luminance output value is located in the first region, setting a G luminance output value in the color-cast-removed RGBW luminance output values as zero;

when it is determined that the W luminance output value is located in the second region, setting a B luminance output value in the color-cast-removed RGBW luminance output values as zero;

when it is determined that the W luminance output value is located in the third region, setting a R luminance output value in the color-cast-removed RGBW luminance output values as zero.

In a possible implementation, in the above method provided in the embodiment of the present disclosure, determining color-cast-removed RGBW luminance output values respectively, according to the determined position relationship, the preset luminance adjustment coefficient, the W actual color coordinate value, RGBW color coordinate values and the W luminance output value further comprises:

when it is determined that the W luminance output value is located in the first region, calculating the color-cast-removed RGBW luminance output values by the following equations:

$$L_{b'} = \left[\frac{1}{y_w} - \left(\frac{x_w}{y_w} - \frac{x_{w'}}{y_{w'}}\right)\frac{y_{w'} - y_r + y_{w'}x_r - x_{w'}y_r}{(x_r y_{w'} - x_{w'} y_r)y_{w'}}\right] * K * L_w$$

$$L_{r'} = \frac{y_{w'} y_r}{y_{w'} - y_r}\left[\left(\frac{1}{y_w} - \frac{1}{y_{w'}}\right) - \left(\frac{1}{y_b} - \frac{1}{y_{w'}}\right)\frac{\left(\frac{x_w}{y_w} - \frac{x_{w'}}{y_{w'}}\right) - \frac{\left(\frac{x_r}{y_r} - \frac{x_{w'}}{y_{w'}}\right)\left(1 - \frac{y_w}{y_{w'}}\right)}{\frac{y_w}{y_r} - \frac{y_w}{y_{w'}}}}{\frac{x_b}{y_b} - \frac{x_{w'}}{y_{w'}} - \frac{y_{w'} y_r}{y_{w'} - y_r} * \left(\frac{1}{y_b} - \frac{1}{y_{w'}}\right)\left(\frac{x_r}{y_r} - \frac{x_{w'}}{y_{w'}}\right)}\right] * K * L_w$$

$$L_{w'} = K * (L_w - L_{b'} - L_{r'})$$

$$L_{g'} = 0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above method provided in the embodiment of the present disclosure, determining color-cast-removed RGBW luminance output values respectively, according to the determined position relationship, the preset luminance adjustment coefficient, the W actual color coordinate value, RGBW color coordinate values and the W luminance output value further comprises:

when it is determined that the W luminance output value is located in the second region, calculating the color-cast-removed RGBW luminance output values by the following equations:

$$L_{r'} = \left[\frac{1}{y_w} - \left(\frac{x_w}{y_w} - \frac{x_{w'}}{y_{w'}}\right)\frac{y_{w'} - y_g + y_{w'}x_g - x_{w'}y_g}{(x_g y_{w'} - x_{w'} y_g)y_{w'}}\right] * K * L_w$$

-continued $$L_{g'} = \frac{y_{w'} y_g}{y_{w'} - y_g}\left[\left(\frac{1}{y_w} - \frac{1}{y_{w'}}\right) - \left(\frac{1}{y_r} - \frac{1}{y_{w'}}\right)\frac{\left(\frac{x_w}{y_w} - \frac{x_{w'}}{y_{w'}}\right) - \frac{\left(\frac{x_g}{y_g} - \frac{x_{w'}}{y_{w'}}\right)\left(1 - \frac{y_w}{y_{w'}}\right)}{\frac{y_w}{y_g} - \frac{y_w}{y_{w'}}}}{\frac{x_r}{y_r} - \frac{x_{w'}}{y_{w'}} - \frac{y_{w'} y_g}{y_{w'} - y_g} * \left(\frac{1}{y_r} - \frac{1}{y_{w'}}\right)\left(\frac{x_g}{y_g} - \frac{x_{w'}}{y_{w'}}\right)}\right] * K * L_w$$

$$L_{w'} = K * (L_w - L_{r'} - L_{g'})$$

$$L_{b'} = 0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above method provided in the embodiment of the present disclosure, determining color-cast-removed RGBW luminance output values respectively, according to the determined position relationship, the preset luminance adjustment coefficient, the W actual color coordinate value, RGBW color coordinate values and the W luminance output value further comprises:

when it is determined that the W luminance output value is located in the third region, calculating the color-cast-removed RGBW luminance output values by the following equations:

$$L_{b'} = \left[\frac{1}{y_w} - \left(\frac{x_w}{y_w} - \frac{x_{w'}}{y_{w'}}\right)\frac{y_{w'} - y_g + y_{w'}x_g - x_{w'}y_g}{(x_g y_{w'} - x_{w'} y_g)y_{w'}}\right] * K * L_w$$

$$L_{g'} = \frac{y_{w'} y_g}{y_{w'} - y_g}\left[\left(\frac{1}{y_w} - \frac{1}{y_{w'}}\right) -\right.$$

-continued $$\left(\frac{1}{y_b}-\frac{1}{y_{w'}}\right)\frac{\left(\frac{x_w}{y_w}-\frac{x_{w'}}{y_{w'}}\right)-\frac{\left(\frac{x_g}{y_g}-\frac{x_{w'}}{y_{w'}}\right)\left(1-\frac{y_w}{y_{w'}}\right)}{\frac{y_w}{y_g}-\frac{y_w}{y_{w'}}}}{\frac{x_b}{y_b}-\frac{x_{w'}}{y_{w'}}-\frac{y_{w'}y_g}{y_{w'}-y_g}*\left(\frac{1}{y_b}-\frac{1}{y_{w'}}\right)\left(\frac{x_g}{y_g}-\frac{x_{w'}}{y_{w'}}\right)}\Bigg]*K*L_w$$

$$L_{w'}=K*(L_w-L_{b'}-L_{g'})$$

$$L_{r'}=0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above method provided in the embodiment of the present disclosure, determining color-cast-removed RGBW luminance output values respectively, according to the position relationship between RGBW color coordinate values to which the RGBW luminance output values correspond respectively and the predetermined actual color coordinate value of the color having monochromatic color cast among RGBW in the chromaticity diagram further comprises:

when it is determined that the color having monochromatic color cast among RGBW is R, determining, in the chromaticity diagram, RGBW color coordinate values to which the RGBW luminance output values correspond respectively and a R actual color coordinate value;

determining, in the chromaticity diagram, position relationship between the R actual color coordinate value and a fourth region, a fifth region, according to the RGBW color coordinate values and the R actual color coordinate value; the fourth region being a region divided by an intersection between BR and an extension line from G to W, and W and R; the fifth region being a region divided by an intersection between GR and an extension line from B to W, and W and R;

determining color-cast-removed RGBW luminance output values respectively, according to the determined position relationship, a preset luminance adjustment coefficient, the R actual color coordinate value, RGBW color coordinate values and a R luminance output value.

In a possible implementation, in the above method provided in the embodiment of the present disclosure, determining color-cast-removed RGBW luminance output values respectively, according to the determined position relationship, the preset luminance adjustment coefficient, the R actual color coordinate value, RGBW color coordinate values and the R luminance output value further comprises:

when it is determined that the R luminance output value is located in the fourth region, setting a G luminance output value in the color-cast-removed RGBW luminance output values as zero;

when it is determined that the R luminance output value is located in the fifth region, setting a B luminance output value in the color-cast-removed RGBW luminance output values as zero.

In a possible implementation, in the above method provided in the embodiment of the present disclosure, determining color-cast-removed RGBW luminance output values respectively, according to the determined position relationship, the preset luminance adjustment coefficient, the R actual color coordinate value, RGBW color coordinate values and the R luminance output value further comprises:

when it is determined that the R luminance output value is located in the fourth region, calculating the color-cast-removed RGBW luminance output values by the following equations:

$$L_{r'}=(L_{b'}+L_{w'}+L_r)*K$$

$$L_{b'}=\frac{y_b}{y_r}*\left(\frac{(y_w-y_{r'})(x_r-x_{r'})-y_w(y_r-y_{r'})(x_w-x_{r'})}{(y_w-y_{r'})(x_{r'}-x_b)-y_w(y_b-y_{r'})(x_{r'}-x_w)}\right)*K*L_r$$

$$L_{w'}=\frac{y_w}{y_r}*\left[\frac{y_{r'}-y_r}{y_w-y_{r'}}-\frac{y_b-y_{r'}}{y_w-y_{r'}}*\frac{(y_w-y_{r'})(x_r-x_{r'})-y_w(y_r-y_{r'})(x_w-x_{r'})}{(y_w-y_{r'})(x_{r'}-x_b)-y_w(y_b-y_{r'})(x_{r'}-x_w)}\right]*K*L_r$$

$$L_{g'}=0$$

where $L_{r'}$, $L_{g'}$, $L_{b'}$ and $L_{w'}$ represent the color-cast-removed RGBW luminance output values respectively; $L_r$ represents the R luminance output value; K represents the luminance adjustment coefficient; $(x_{r'}, y_{r'})$ represents the R actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above method provided in the embodiment of the present disclosure, determining color-cast-removed RGBW luminance output values respectively, according to the determined position relationship, the preset luminance adjustment coefficient, the R actual color coordinate value, RGBW color coordinate values and the R luminance output value further comprises:

when it is determined that the R luminance output value is located in the fifth region, calculating the color-cast-removed RGBW luminance output values by the following equations:

$$L_{r'}=(L_{g'}+L_{w'}+L_r)*K$$

$$L_{g'}=\frac{y_g}{y_r}*\left(\frac{(y_w-y_{r'})(x_r-x_{r'})-y_w(y_r-y_{r'})(x_w-x_{r'})}{(y_w-y_{r'})(x_{r'}-x_g)-y_w(y_g-y_{r'})(x_{r'}-x_w)}\right)*K*L_r$$

$$L_{w'}=\frac{y_w}{y_r}*\left[\frac{y_{r'}-y_r}{y_w-y_{r'}}-\frac{y_g-y_{r'}}{y_w-y_{r'}}*\frac{(y_w-y_{r'})(x_r-x_{r'})-y_w(y_r-y_{r'})(x_w-x_{r'})}{(y_w-y_{r'})(x_{r'}-x_g)-y_w(y_g-y_{r'})(x_{r'}-x_w)}\right]*K*L_r$$

$$L_{b'}=0$$

where $L_{r'}$, $L_{g'}$, $L_{b'}$ and $L_{w'}$ represent the color-cast-removed RGBW luminance output values respectively; $L_r$ represents the R luminance output value; K represents the luminance adjustment coefficient; $(x_{r'}, y_{r'})$ represents the R actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above method provided in the embodiment of the present disclosure, determining color-cast-removed RGBW luminance output values respectively, according to the position relationship between RGBW color coordinate values to which the RGBW luminance output values correspond respectively and the predetermined actual color coordinate value of the color having monochromatic color cast among RGBW in the chromaticity diagram further comprises:

when it is determined that the color having monochromatic color cast among RGBW is G, determining, in the chromaticity diagram, RGBW color coordinate values to which the RGBW luminance output values correspond respectively and a G actual color coordinate value;

determining, in the chromaticity diagram, position relationship between the G actual color coordinate value and a sixth region, a seventh region, according to the RGBW color coordinate values and the G actual color coordinate value; the sixth region being a region divided by an intersection between BG and an extension line from R to W, and W and G; the seventh region being a region divided by an intersection between GR and an extension line from B to W, and W and G;

determining color-cast-removed RGBW luminance output values respectively, according to the determined position relationship, predetermined a luminance adjustment coefficient, the G actual color coordinate value, RGBW color coordinate values and a G luminance output value.

In a possible implementation, in the above method provided in the embodiment of the present disclosure, determining color-cast-removed RGBW luminance output values respectively, according to the determined position relationship, the preset luminance adjustment coefficient, the G actual color coordinate value, RGBW color coordinate values and the G luminance output value further comprises:

when it is determined that the G luminance output value is located in the sixth region, setting a R luminance output value in the color-cast-removed RGBW luminance output values as zero;

when it is determined that the G luminance output value is located in the seventh region, setting a B luminance output value in the color-cast-removed RGBW luminance output values as zero.

In a possible implementation, in the above method provided in the embodiment of the present disclosure, determining color-cast-removed RGBW luminance output values respectively, according to the determined position relationship, the preset luminance adjustment coefficient, the G actual color coordinate value, RGBW color coordinate values and the G luminance output value further comprises:

when it is determined that the G luminance output value is located in the sixth region, calculating the color-cast-removed RGBW luminance output values by the following equations:

$$L_{g'} = (L_g + L_{w'} + L_{b'}) * K$$

$$L_{b'} = \frac{y_b}{y_g} * \frac{(y_w - y_{g'})(x_g - x_{g'}) - y_w(y_b - y_{g'})(x_w - x_{g'})}{(y_w - y_{g'})(x_{g'} - x_g) - y_w(y_g - y_{g'})(x_{g'} - x_w)} * K * L_g$$

$$L_{w'} = \frac{y_w}{y_g} * \left[ \frac{y_{g'} - y_b}{y_w - y_{g'}} - \frac{y_g - y_{g'}}{y_w - y_{g'}} * \frac{\begin{array}{c}(y_w - y_{g'})(x_b - x_{g'}) - \\ y_w(y_b - y_{g'})(x_w - x_{g'})\end{array}}{\begin{array}{c}(y_w - y_{g'})(x_{g'} - x_b) - \\ y_w(y_g - y_{g'})(x_{g'} - x_w)\end{array}} \right] * K * L_g$$

$$L_{r'} = 0$$

where $L_{r'}$, $L_{g'}$, $L_{b'}$ and $L_{w'}$ represent the color-cast-removed RGBW luminance output values respectively; $L_g$ represents the G luminance output value; K represents the luminance adjustment coefficient; $(x_{g'}, y_{g'})$ represents the G actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above method provided in the embodiment of the present disclosure, determining color-cast-removed RGBW luminance output values respectively, according to the determined position relationship, the preset luminance adjustment coefficient, the G actual color coordinate value, RGBW color coordinate values and the G luminance output value further comprises:

when it is determined that the G luminance output value is located in the seventh region, calculating the color-cast-removed RGBW luminance output values by the following equations:

$$L_{g'} = (L_g + L_{w'} + L_{r'}) * K$$

$$L_{r'} = \frac{y_r}{y_g} * \frac{(y_w - y_{g'})(x_g - x_{g'}) - y_w(y_r - y_{g'})(x_w - x_{g'})}{(y_w - y_{g'})(x_{g'} - x_g) - y_w(y_g - y_{g'})(x_{g'} - x_w)} * K * L_g$$

$$L_{w'} = \frac{y_w}{y_g} * \left[ \frac{y_{g'} - y_r}{y_w - y_{g'}} - \frac{y_g - y_{g'}}{y_w - y_{g'}} * \frac{\begin{array}{c}(y_w - y_{g'})(x_r - x_{g'}) - \\ y_w(y_r - y_{g'})(x_w - x_{g'})\end{array}}{\begin{array}{c}(y_w - y_{g'})(x_{g'} - x_b) - \\ y_w(y_g - y_{g'})(x_{g'} - x_w)\end{array}} \right] * K * L_g$$

$$L_{b'} = 0$$

where $L_{r'}$, $L_{g'}$, $L_{b'}$ and $L_{w'}$ represent the color-cast-removed RGBW luminance output values respectively; $L_g$ represents the G luminance output value; K represents the luminance adjustment coefficient; $(x_{g'}, y_{g'})$ represents the G actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above method provided in the embodiment of the present disclosure, determining color-cast-removed RGBW luminance output values respectively, according to the position relationship between RGBW color coordinate values to which the RGBW luminance output values correspond respectively and the predetermined actual color coordinate value of the color having monochromatic color cast among RGBW in the chromaticity diagram further comprises:

when it is determined that the color having monochromatic color cast among RGBW is B, determining, in the chromaticity diagram, RGBW color coordinate values to which the RGBW luminance output values correspond respectively and a B actual color coordinate value;

determining, in the chromaticity diagram, position relationship between the B actual color coordinate value and an eighth region, a ninth region, according to the RGBW color coordinate values and the B actual color coordinate value; the eighth region being a region divided by an intersection between BG and an extension line from R to W, and W and B; the ninth region being a region divided by an intersection between BR and an extension line from G to W, and W and B;

determining color-cast-removed RGBW luminance output values respectively, according to the determined position relationship, a preset luminance adjustment coefficient, the B actual color coordinate value, RGBW color coordinate values and a B luminance output value.

In a possible implementation, in the above method provided in the embodiment of the present disclosure, determining color-cast-removed RGBW luminance output values respectively, according to the determined position relationship, the preset luminance adjustment coefficient, the B actual color coordinate value, RGBW color coordinate values and the B luminance output value further comprises:

when it is determined that the B luminance output value is located in the eighth region, setting a R luminance output value in the color-cast-removed RGBW luminance output values as zero;

when it is determined that the B luminance output value is located in the ninth region, setting a G luminance output value in the color-cast-removed RGBW luminance output values as zero.

In a possible implementation, in the above method provided in the embodiment of the present disclosure, determining color-cast-removed RGBW luminance output values respectively, according to the determined position relationship, the preset luminance adjustment coefficient, the B actual color coordinate value, RGBW color coordinate values and the B luminance output value further comprises:

when it is determined that the B luminance output value is located in the eighth region, calculating the color-cast-removed RGBW luminance output values by the following equations:

$$L_{b'} = (L_b + L_{w'} + L_{g'}) * K$$

$$L_{g'} = \frac{y_g}{y_b} * \frac{(y_w - y_{g'})(x_g - x_{g'}) - y_w(y_g - y_{g'})(x_w - x_{g'})}{(y_w - y_{g'})(x_{g'} - x_g) - y_w(y_g - y_{g'})(x_{g'} - x_w)} * K * L_b$$

$$L_{w'} = \frac{y_w}{y_b} * \left[ \frac{y_{g'} - y_g}{y_w - y_{g'}} - \frac{y_g - y_{g'}}{y_w - y_{g'}} * \frac{\begin{array}{c}(y_w - y_{g'})(x_g - x_{g'}) - \\ y_w(y_g - y_{g'})(x_w - x_{g'})\end{array}}{\begin{array}{c}(y_w - y_{g'})(x_{g'} - x_b) - \\ y_w(y_g - y_{g'})(x_{g'} - x_w)\end{array}} \right] * K * L_b$$

$$L_{r'} = 0$$

where $L_{r'}$, $L_{g'}$, $L_{b'}$ and $L_{w'}$ represent the color-cast-removed RGBW luminance output values respectively; $L_b$ represents the B luminance output value; K represents the luminance adjustment coefficient; $(x_{b'}, y_{b'})$ represents the B actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above method provided in the embodiment of the present disclosure, determining color-cast-removed RGBW luminance output values respectively, according to the determined position relationship, the preset luminance adjustment coefficient, the B actual color coordinate value, RGBW color coordinate values and the B luminance output value further comprises:

when it is determined that the B luminance output value is located in the ninth region, calculating the color-cast-removed RGBW luminance output values by the following equations:

$$L_{b'} = (L_b + L_w + L_r) * K$$

$$L_{r'} = \frac{y_r}{y_b} * \frac{(y_w - y_{b'})(x_r - x_{b'}) - y_w(y_r - y_{b'})(x_w - x_{b'})}{(y_w - y_{b'})(x_{b'} - x_r) - y_w(y_r - y_{b'})(x_{b'} - x_w)} * K * L_b$$

-continued $$L_{w'} = \frac{y_w}{y_b} * \left[ \frac{y_{b'} - y_r}{y_w - y_{b'}} - \frac{y_r - y_{b'}}{y_w - y_{b'}} * \frac{\begin{array}{c}(y_w - y_{b'})(x_r - x_{b'}) - \\ y_w(y_r - y_{b'})(x_w - x_{b'})\end{array}}{\begin{array}{c}(y_w - y_{b'})(x_{b'} - x_g) - \\ y_w(y_r - y_{b'})(x_{b'} - x_w)\end{array}} \right] * K * L_b$$

$$L_{g'} = 0$$

where $L_{r'}$, $L_{g'}$, $L_{b'}$ and $L_{w'}$ represent the color-cast-removed RGBW luminance output values respectively; $L_b$ represents the B luminance output value; K represents the luminance adjustment coefficient; $(x_{b'}, y_{b'})$ represents the B actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

An embodiment of the present disclosure also provides a device for image conversion from RGB signals into RGBW signals, comprising:

a signal receiving unit configured to receive RGB input signals;

a first conversion unit configured to convert received RGB input signals into corresponding RGB luminance input values, respectively;

a second conversion unit configured to convert the RGB luminance input values into RGBW luminance output values;

a color cast removing unit configured to determine color-cast-removed RGBW luminance output values respectively, according to a position relationship between RGBW color coordinate values to which the RGBW luminance output values correspond respectively and a predetermined actual color coordinate value of a color having monochromatic color cast among RGBW in a chromaticity diagram;

an inverse conversion unit configured to convert the color-cast-removed RGBW luminance output values into corresponding RGBW output signals;

a signal output unit configured to output the RGBW output signals.

In a possible implementation, in the above device provided in the embodiment of the present disclosure, the color cast removing unit further comprises:

a first optical calculation sub-unit configured to when it is determined that the color having monochromatic color cast among RGBW is W, determine, in the chromaticity diagram, RGBW color coordinate values to which the RGBW luminance output values correspond respectively and a W actual color coordinate value;

a first region selecting sub-unit configured to determine in the chromaticity diagram position relationship between the W actual color coordinate value and a first region, a second region, a third region, according to the RGBW color coordinate values and the W actual color coordinate value; the first region being a region divided by an intersection between BG and an extension line from R to W, an intersection between RG and an extension line from B to W, and W and G; the second region being a region divided by an intersection between BR and an extension line from G to W, an intersection between BG and an extension line from R to W, and W and B; the third region being a region divided by an intersection between RG and an extension line from B to W, an intersection between RB and an extension line from G to W, and W and R;

a first luminance calculation sub-unit configured to determine color-cast-removed RGBW luminance output values respectively, according to the determined position relationship, a preset luminance adjustment coefficient, the W actual color coordinate value, RGBW color coordinate values and a W luminance output value.

In a possible implementation, in the above device provided in the embodiment of the present disclosure, the first luminance calculation sub-unit is configured to when it is determined that the W luminance output value is located in the first region, set a G luminance output value in the color-cast-removed RGBW luminance output values as zero; when it is determined that the W luminance output value is located in the second region, set a B luminance output value in the color-cast-removed RGBW luminance output values as zero; when it is determined that the W luminance output value is located in the third region, set a R luminance output value in the color-cast-removed RGBW luminance output values as zero.

In a possible implementation, in the above device provided in the embodiment of the present disclosure, the first luminance calculation sub-unit is configured to:

when it is determined that the W luminance output value is located in the first region, calculate the color-cast-removed RGBW luminance output values by the following equations:

$$L_{b'} = \left[\frac{1}{y_w} - \left(\frac{x_w}{y_w} - \frac{x_{w'}}{y_{w'}}\right)\frac{y_{w'} - y_r + y_{w'}x_r - x_{w'}y_r}{(x_r y_{w'} - x_{w'} y_r)y_{w'}}\right] * K * L_w$$

$$L_{r'} = \frac{y_{w'} y_r}{y_{w'} - y_r}\left[\left(\frac{1}{y_w} - \frac{1}{y_{w'}}\right) - \left(\frac{1}{y_b} - \frac{1}{y_{w'}}\right)\frac{\left(\frac{x_w}{y_w} - \frac{x_{w'}}{y_{w'}}\right) - \frac{\left(\frac{x_r}{y_r} - \frac{x_{w'}}{y_{w'}}\right)\left(1 - \frac{y_w}{y_{w'}}\right)}{\frac{y_w}{y_r} - \frac{y_w}{y_{w'}}}}{\frac{x_b}{y_b} - \frac{x_{w'}}{y_{w'}} - \frac{y_{w'} y_r}{y_{w'} - y_r} * \left(\frac{1}{y_b} - \frac{1}{y_{w'}}\right)\left(\frac{x_r}{y_r} - \frac{x_{w'}}{y_{w'}}\right)}\right] * K * L_w$$

$$L_{w'} = K * (L_w - L_{b'} - L_{r'})$$

$$L_{g'} = 0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above device provided in the embodiment of the present disclosure, the first luminance calculation sub-unit is configured to:

when it is determined that the W luminance output value is located in the second region, calculate the color-cast-removed RGBW luminance output values by the following equations:

$$L_{r'} = \left[\frac{1}{y_w} - \left(\frac{x_w}{y_w} - \frac{x_{w'}}{y_{w'}}\right)\frac{y_{w'} - y_g + y_{w'}x_g - x_{w'}y_g}{(x_g y_{w'} - x_{w'} y_g)y_{w'}}\right] * K * L_w$$

-continued $$L_{g'} = \frac{y_{w'} y_g}{y_{w'} - y_g}\left[\left(\frac{1}{y_w} - \frac{1}{y_{w'}}\right) - \left(\frac{1}{y_r} - \frac{1}{y_{w'}}\right)\frac{\left(\frac{x_w}{y_w} - \frac{x_{w'}}{y_{w'}}\right) - \frac{\left(\frac{x_g}{y_g} - \frac{x_{w'}}{y_{w'}}\right)\left(1 - \frac{y_w}{y_{w'}}\right)}{\frac{y_w}{y_g} - \frac{y_w}{y_{w'}}}}{\frac{x_r}{y_r} - \frac{x_{w'}}{y_{w'}} - \frac{y_{w'} y_g}{y_{w'} - y_g} * \left(\frac{1}{y_r} - \frac{1}{y_{w'}}\right)\left(\frac{x_g}{y_g} - \frac{x_{w'}}{y_{w'}}\right)}\right] * K * L_w$$

$$L_{w'} = K * (L_w - L_{r'} - L_{g'})$$

$$L_{b'} = 0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above device provided in the embodiment of the present disclosure, the first luminance calculation sub-unit is configured to:

when it is determined that the W luminance output value is located in the third region, calculate the color-cast-removed RGBW luminance output values by the following equations:

$$L_{b'} = \left[\frac{1}{y_w} - \left(\frac{x_w}{y_w} - \frac{x_{w'}}{y_{w'}}\right)\frac{y_{w'} - y_g + y_{w'}x_g - x_{w'}y_g}{(x_g y_{w'} - x_{w'} y_g)y_{w'}}\right] * K * L_w$$

$$L_{g'} = \frac{y_{w'} y_g}{y_{w'} - y_g}\left[\left(\frac{1}{y_w} - \frac{1}{y_{w'}}\right) - \left(\frac{1}{y_b} - \frac{1}{y_{w'}}\right)\frac{\left(\frac{x_w}{y_w} - \frac{x_{w'}}{y_{w'}}\right) - \frac{\left(\frac{x_g}{y_g} - \frac{x_{w'}}{y_{w'}}\right)\left(1 - \frac{y_w}{y_{w'}}\right)}{\frac{y_w}{y_g} - \frac{y_w}{y_{w'}}}}{\frac{x_b}{y_b} - \frac{x_{w'}}{y_{w'}} - \frac{y_{w'} y_g}{y_{w'} - y_g} * \left(\frac{1}{y_b} - \frac{1}{y_{w'}}\right)\left(\frac{x_g}{y_g} - \frac{x_{w'}}{y_{w'}}\right)}\right] * K * L_w$$

$$L_{w'} = K * (L_w - L_{b'} - L_{g'})$$

$$L_{r'} = 0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above device provided in the embodiment of the present disclosure, the color cast removing unit further comprises:

a second optical calculation sub-unit configured to when it is determined that the color having monochromatic color cast among RGBW is R, determine, in the chromaticity diagram, RGBW color coordinate values to which the RGBW luminance output values correspond respectively and a R actual color coordinate value;

a second region selecting sub-unit configured to determine in the chromaticity diagram position relationship between the R actual color coordinate value and a fourth region, a fifth region, according to the RGBW color coordinate values and the R actual color coordinate value; the fourth region being a region divided by an intersection between BR and an extension line from G to W, and W and R; the fifth region being a region divided by an intersection between GR and an extension line from B to W, and W and R;

a second luminance calculation sub-unit configured to determine color-cast-removed RGBW luminance output values respectively, according to the determined position relationship, a preset luminance adjustment coefficient, the R actual color coordinate value, RGBW color coordinate values and a R luminance output value.

In a possible implementation, in the above device provided in the embodiment of the present disclosure, the second luminance calculation sub-unit is configured to: when it is determined that the R luminance output value is located in the fourth region, set a G luminance output value in the color-cast-removed RGBW luminance output values as zero; when it is determined that the R luminance output value is located in the fifth region, set a B luminance output value in the color-cast-removed RGBW luminance output values as zero.

In a possible implementation, in the above device provided in the embodiment of the present disclosure, the second luminance calculation sub-unit is configured to:

when it is determined that the R luminance output value is located in the fourth region, calculate the color-cast-removed RGBW luminance output values by the following equations:

$$L_{r'} = (L_{b'} + L_{w'} + L_r) * K$$

$$L_{b'} = \frac{y_b}{y_r} * \frac{(y_w - y_{r'})(x_r - x_{r'}) - y_w(y_r - y_{r'})(x_w - x_{r'})}{(y_w - y_{r'})(x_{r'} - x_b) - y_w(y_b - y_{r'})(x_{r'} - x_w)} * K * L_r$$

$$L_{w'} = \frac{y_w}{y_r} * \left[ \frac{y_{r'} - y_r}{y_w - y_{r'}} - \frac{y_b - y_{r'}}{y_w - y_{r'}} * \frac{\begin{array}{r}(y_w - y_{r'})(x_r - x_{r'}) - \\ y_w(y_r - y_{r'})(x_w - x_{r'})\end{array}}{\begin{array}{r}(y_w - y_{r'})(x_{r'} - x_b) - \\ y_w(y_b - y_{r'})(x_{r'} - x_w)\end{array}} \right] * K * L_r$$

$$L_{g'} = 0$$

where $L_{r'}$, $L_{g'}$, $L_{b'}$ and $L_{w'}$ represent the color-cast-removed RGBW luminance output values respectively; $L_r$ represents the R luminance output value; K represents the luminance adjustment coefficient; $(x_{r'}, y_{r'})$ represents the R actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above device provided in the embodiment of the present disclosure, the second luminance calculation sub-unit is configured to:

when it is determined that the R luminance output value is located in the fifth region, calculate the color-cast-removed RGBW luminance output values by the following equations:

$$L_{r'} = (L_{g'} + L_{w'} + L_r) * K$$

$$L_{g'} = \frac{y_g}{y_r} * \frac{(y_w - y_{r'})(x_r - x_{r'}) - y_w(y_r - y_{r'})(x_w - x_{r'})}{(y_w - y_{r'})(x_{r'} - x_g) - y_w(y_g - y_{r'})(x_{r'} - x_w)} * K * L_r$$

$$L_{w'} = \frac{y_w}{y_r} * \left[ \frac{y_{r'} - y_r}{y_w - y_{r'}} - \frac{y_g - y_{r'}}{y_w - y_{r'}} * \frac{\begin{array}{r}(y_w - y_{r'})(x_r - x_{r'}) - \\ y_w(y_r - y_{r'})(x_w - x_{r'})\end{array}}{\begin{array}{r}(y_w - y_{r'})(x_{r'} - x_g) - \\ y_w(y_g - y_{r'})(x_{r'} - x_w)\end{array}} \right] * K * L_r$$

$$L_{b'} = 0$$

where $L_{r'}$, $L_{g'}$, $L_{b'}$ and $L_{w'}$ represent the color-cast-removed RGBW luminance output values respectively; $L_r$ represents the R luminance output value; K represents the luminance adjustment coefficient; $(x_{r'}, y_{r'})$ represents the R actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above device provided in the embodiment of the present disclosure, the color cast removing unit further comprises:

a third optical calculation sub-unit configured to when it is determined that the color having monochromatic color cast among RGBW is G, determine, in the chromaticity diagram, RGBW color coordinate values to which the RGBW luminance output values correspond respectively and a G actual color coordinate value;

a third region selecting sub-unit configured to determine in the chromaticity diagram position relationship between the G actual color coordinate value and a sixth region, a seventh region, according to the RGBW color coordinate values and the G actual color coordinate value; the sixth region being a region divided by an intersection between BG and an extension line from R to W, and W and G; the seventh region being a region divided by an intersection between GR and an extension line from B to W, and W and G;

a third luminance calculation sub-unit configured to determine color-cast-removed RGBW luminance output values respectively, according to the determined position relationship, a preset luminance adjustment coefficient, the G actual color coordinate value, RGBW color coordinate values and a G luminance output value.

In a possible implementation, in the above device provided in the embodiment of the present disclosure, the third luminance calculation sub-unit is configured to: when it is determined that the G luminance output value is located in the sixth region, set a R luminance output value in the color-cast-removed RGBW luminance output values as zero; when it is determined that the G luminance output value is located in the seventh region, set a B luminance output value in the color-cast-removed RGBW luminance output values as zero.

In a possible implementation, in the above device provided in the embodiment of the present disclosure, the third luminance calculation sub-unit is configured to:

when it is determined that the G luminance output value is located in the sixth region, calculate the color-cast-removed RGBW luminance output values by the following equations:

$$L_{g'} = (L_g + L_{w'} + L_{b'}) * K$$

$$L_{b'} = \frac{y_b}{y_g} * \left( \frac{(y_w - y_{g'})(x_g - x_{g'}) - y_w(y_b - y_{g'})(x_w - x_{g'})}{(y_w - y_{g'})(x_{g'} - x_g) - y_w(y_g - y_{g'})(x_{g'} - x_w)} \right) * K * L_g$$

$$L_{w'} = \frac{y_w}{y_g} * \left[ \frac{y_{g'} - y_b}{y_w - y_{g'}} - \frac{y_g - y_{g'}}{y_w - y_{g'}} * \frac{\begin{array}{c}(y_w - y_{g'})(x_b - x_{g'}) - \\ y_w(y_b - y_{g'})(x_w - x_{g'})\end{array}}{\begin{array}{c}(y_w - y_{g'})(x_{g'} - x_b) - \\ y_w(y_g - y_{g'})(x_{g'} - x_w)\end{array}} \right] * K * L_g$$

$$L_{r'} = 0$$

where $L_{r'}$, $L_{g'}$, $L_{b'}$ and $L_{w'}$ represent the color-cast-removed RGBW luminance output values respectively; $L_g$ represents the G luminance output value; K represents the luminance adjustment coefficient; $(x_{g'}, y_{g'})$ represents the G actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above device provided in the embodiment of the present disclosure, the third luminance calculation sub-unit is configured to:

when it is determined that the G luminance output value is located in the seventh region, calculate the color-cast-removed RGBW luminance output values by the following equations:

$$L_{g'} = (L_g + L_{w'} + L_{r'}) * K$$

$$L_{r'} = \frac{y_r}{y_g} * \frac{(y_w - y_{g'})(x_g - x_{g'}) - y_w(y_r - y_{g'})(x_w - x_{g'})}{(y_w - y_{g'})(x_{g'} - x_g) - y_w(y_g - y_{g'})(x_{g'} - x_w)} * K * L_g$$

$$L_{w'} = \frac{y_w}{y_g} * \left[ \frac{y_{g'} - y_r}{y_w - y_{g'}} - \frac{y_g - y_{g'}}{y_w - y_{g'}} * \frac{\begin{array}{c}(y_w - y_{g'})(x_r - x_{g'}) - \\ y_w(y_r - y_{g'})(x_w - x_{g'})\end{array}}{\begin{array}{c}(y_w - y_{g'})(x_{g'} - x_b) - \\ y_w(y_g - y_{g'})(x_{g'} - x_w)\end{array}} \right] * K * L_g$$

$$L_{b'} = 0$$

where $L_{r'}$, $L_{g'}$, $L_{b'}$ and $L_{w'}$ represent the color-cast-removed RGBW luminance output values respectively; $L_g$ represents the G luminance output value; K represents the luminance adjustment coefficient; $(x_{g'}, y_{g'})$ represents the G actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above device provided in the embodiment of the present disclosure, the color cast removing unit further comprises:

a fourth optical calculation sub-unit configured to when it is determined that the color having monochromatic color cast among RGBW is B, determine, in the chromaticity diagram, RGBW color coordinate values to which the RGBW luminance output values correspond respectively and a B actual color coordinate value;

a fourth region selecting sub-unit configured to determine in the chromaticity diagram position relationship between the B actual color coordinate value and an eighth region, a ninth region, according to the RGBW color coordinate values and the B actual color coordinate value; the eighth region being a region divided by an intersection between BG and an extension line from R to W, and W and B; the ninth region being a region divided by an intersection between BR and an extension line from G to W, and W and B;

a fourth luminance calculation sub-unit configured to determine color-cast-removed RGBW luminance output values respectively, according to the determined position relationship, a preset luminance adjustment coefficient, the B actual color coordinate value, RGBW color coordinate values and a B luminance output value.

In a possible implementation, in the above device provided in the embodiment of the present disclosure, the fourth luminance calculation sub-unit is configured to: when it is determined that the B luminance output value is located in the eighth region, set a R luminance output value in the color-cast-removed RGBW luminance output values as zero; when it is determined that the B luminance output value is located in the ninth region, set a G luminance output value in the color-cast-removed RGBW luminance output values as zero.

In a possible implementation, in the above device provided in the embodiment of the present disclosure, the fourth luminance calculation sub-unit is configured to:

when it is determined that the B luminance output value is located in the eighth region, calculate the color-cast-removed RGBW luminance output values by the following equations:

$$L_{b'} = (L_b + L_{w'} + L_{g'}) * K$$

$$L_{g'} = \frac{y_g}{y_b} * \frac{(y_w - y_{g'})(x_g - x_{g'}) - y_w(y_g - y_{g'})(x_w - x_{g'})}{(y_w - y_{g'})(x_{g'} - x_g) - y_w(y_g - y_{g'})(x_{g'} - x_w)} * K * L_b$$

$$L_{w'} = \frac{y_w}{y_b} * \left[ \frac{y_{g'} - y_g}{y_w - y_{g'}} - \frac{y_g - y_{g'}}{y_w - y_{g'}} * \frac{\begin{array}{c}(y_w - y_{g'})(x_g - x_{g'}) - \\ y_w(y_g - y_{g'})(x_w - x_{g'})\end{array}}{\begin{array}{c}(y_w - y_{g'})(x_{g'} - x_b) - \\ y_w(y_g - y_{g'})(x_{g'} - x_w)\end{array}} \right] * K * L_b$$

$$L_{r'} = 0$$

where $L_{r'}$, $L_{g'}$, $L_{b'}$ and $L_{w'}$ represent the color-cast-removed RGBW luminance output values respectively; $L_b$ represents the B luminance output value; K represents the luminance adjustment coefficient; $(x_{b'}, y_{b'})$ represents the B actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In a possible implementation, in the above device provided in the embodiment of the present disclosure, the fourth luminance calculation sub-unit is configured to:

when it is determined that the B luminance output value is located in the ninth region, calculate the color-cast-removed RGBW luminance output values by the following equations:

$$L_{b'} = (L_b + L_w + L_r) * K$$

$$L_{r'} = \frac{y_r}{y_b} * \frac{(y_w - y_{b'})(x_r - x_{b'}) - y_w(y_r - y_{b'})(x_w - x_{b'})}{(y_w - y_{b'})(x_{b'} - x_r) - y_w(y_r - y_{b'})(x_{b'} - x_w)} * K * L_b$$

$$L_{w'} = \frac{y_w}{y_b} * \left[ \frac{y_{b'} - y_r}{y_w - y_{b'}} - \frac{y_r - y_{b'}}{y_w - y_{b'}} * \frac{\begin{array}{c}(y_w - y_{b'})(x_r - x_{b'}) - \\ y_w(y_r - y_{b'})(x_w - x_{b'})\end{array}}{\begin{array}{c}(y_w - y_{b'})(x_{b'} - x_g) - \\ y_w(y_r - y_{b'})(x_{b'} - x_w)\end{array}} \right] * K * L_b$$

-continued $$L_{g'} = 0$$

where $L_{r'}$, $L_{g'}$, $L_{b'}$ and $L_{w'}$ represent the color-cast-removed RGBW luminance output values respectively; $L_b$ represents the B luminance output value; K represents the luminance adjustment coefficient; $(x_{b'}, y_{b'})$ represents the B actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

DETAILED DESCRIPTION OF THE EMBODIMENTS

Hereinafter, specific implementations of the method for image conversion from RGB signals into RGBW signals and device provided by the embodiments of the present disclosure will be described in detail with reference to the accompanying drawings.

Figure 1:
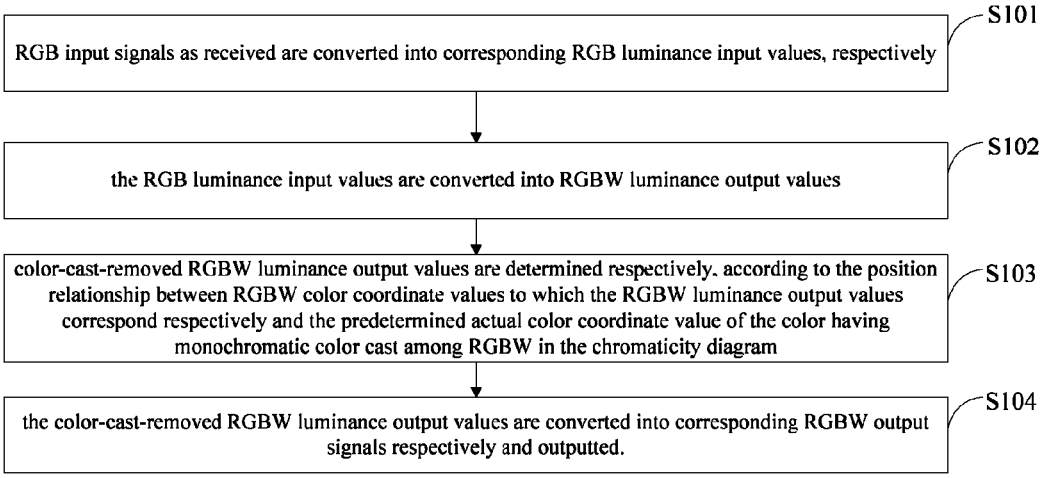
FIG. 1 is a first flowchart of the method for image conversion from RGB signals into RGBW signals provided by an embodiment of the present disclosure.

FIG. 1 shows a method for image conversion from RGB signals into RGBW signals provided by an embodiment of the present disclosure.

At step S101, RGB input signals as received are converted into corresponding RGB luminance input values, respectively.

At step S102, the RGB luminance input values are converted into RGBW luminance output values.

At step S103, color-cast-removed RGBW luminance output values are determined, respectively, according to the position relationship between RGBW color coordinate values to which the RGBW luminance output values correspond respectively and the predetermined actual color coordinate value of the color having monochromatic color cast among RGBW in the chromaticity diagram.

At step S104, the color-cast-removed RGBW luminance output values are converted into corresponding RGBW output signals respectively and outputted.

Next, detailed descriptions will be given to the implementation of the respective steps in the method for image conversion provided in the embodiment of the present disclosure.

Figure 2:
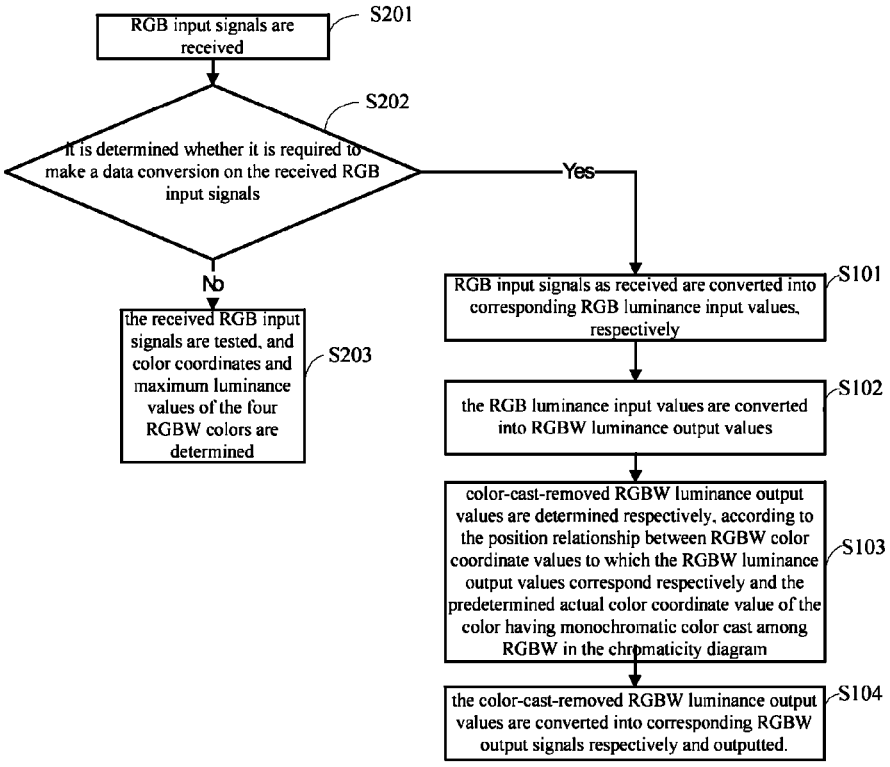
FIG. 2 is a second flowchart of the method for image conversion from RGB signals into RGBW signals provided in the embodiment of the present disclosure.

FIG. 2 is a first flowchart of the method for image conversion from RGB signals into RGBW signals provided in the embodiment of the present disclosure.

In particular, in the method for image conversion provided in the embodiment of the present disclosure, before step S101 is carried out, as shown in FIG. 2, when the RGB input signals are received, the steps as follows can be performed.

At step S201, RGB input signals are received.

In the present embodiment, an 8-bit input signal is taken as an example for an input signal for each color in the RGB input signals, that is, the data signals corresponding to the three RGB colors can be represented by grayscale values within a range of 0-255 respectively.

At step S202, it is determined whether it is required to make a data conversion on the received RGB input signals according to an enable signal En input from the external as received, that is, whether to perform steps S101 to S104. For example, if the enable signal input from the external En=1, a data conversion is made on the received RGB input signals, that is, it is required to perform steps S101 to S104; if the enable signal input from the external En=0, step S203 is performed.

At step S203, the received RGB input signals are tested, and color coordinates and maximum luminance values of the four RGBW colors are determined.

In particular, the received RGB input signals can be tested according to a testing control signal Test; for example, when Test=1, the signal output values $R_0$, $B_0$ and $G_0$ correspond to signal input values Ri, Bi and Gi, respectively, the signal output value $W_0=0$; the color coordinates $(R(x_r,y_r), G(x_g, y_g), B(x_b,y_b))$ and corresponding maximum luminance values $(L_{Rmax}, L_{Gmax}, L_{Bmax})$ of red (R), green (G) and blue (B) can be measured by using the signal output values. When Test=0, the signal output values $R_0=0$, $B_0=0$, $G_0=0$, $W_0=1$, the color coordinates $(W(x_w,y_w))$ and a corresponding maximum luminance value $(L_{Wmax})$ of White can be measured by using the signal output values.

Preferably, in the step S101 in the method for image conversion provided in the embodiment of the present disclosure, the received RGB input signals are converted into the corresponding RGB luminance input values respectively. In an implementation, it can be realized by gamma conversion, that is, the RGB input signals are converted into the corresponding RGB luminance input values through the following equations:

$$L_R = L_{Rmax} \times \left(\frac{Ri}{255}\right)^{\gamma};\ L_G = L_{Gmax} \times \left(\frac{Gi}{255}\right)^{\gamma};\ L_B = L_{Bmax} \times \left(\frac{Bi}{255}\right)^{\gamma};$$

where $L_R$ represents a red luminance input value in the RGB luminance input values, $L_G$ represents a green luminance input value in the RGB luminance input values, $L_B$ represents a blue luminance input value in the RGB luminance input values; Ri represents a red input signal value in the RGB input signals, Gi represents a blue input signal value in the RGB input signals, Bi represents a green input signal value in the RGB input signals; $L_{Rmax}$ represents a red maximum luminance value, $L_{Gmax}$ represents a green maximum luminance value, $L_{Bmax}$ represents a blue maximum luminance value; γ represents a gamma conversion factor.

Typically, in a specific computation, the gamma conversion factor γ is usually set as 2.2.

In particular, at step S102 in the method for image conversion provided in the embodiment of the present disclosure, converting the RGB luminance input values into RGBW luminance output values can be implemented by many conventional manners, no more details discussed here.

Further, after converting the RGB luminance input values into RGBW luminance output values, color-cast-removed RGBW luminance output values can be determined according to a position relationship between a predetermined actual color coordinate value of a single color having color cast among four RGBW colors and RGBW color coordinate values calculated previously in a chromaticity diagram.

Hereinafter, how to specifically determine the color-cast-removed RGBW luminance output values in the cases that the single color having color cast is W, R, G and B respectively, will be described in detail.

First Case: by an actual measurement, it is obtained that the color having color shifting among RGBW is only W, that is, it is determined that the the color having monochromatic color cast among RGBW is W.

Figure 3:
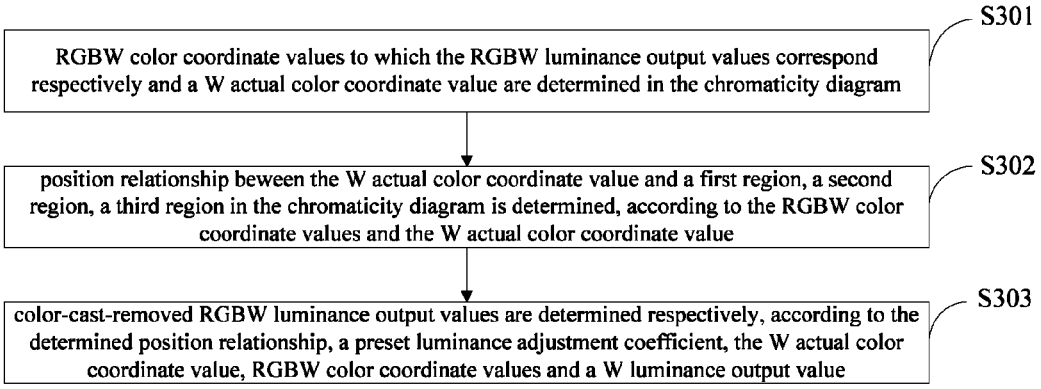
FIG. 3 is a flowchart of the method for image conversion from RGB signals into RGBW signals when a color having color cast is W provided in the embodiment of the present disclosure.

FIG. 3 is a flowchart of the method for image conversion from RGB signals into RGBW signals when a color having color cast is W provided in the embodiment of the present disclosure.

In particular, at step S103 of the method for image conversion provided in the embodiment of the present disclosure, determining color-cast-removed RGBW luminance output values respectively, according to the position relationship between RGBW color coordinate values to which the RGBW luminance output values correspond respectively and the predetermined actual color coordinate value of the color having monochromatic color cast among RGBW in the chromaticity diagram can be realized by the following steps, as shown in FIG. 3.

Figure 4:
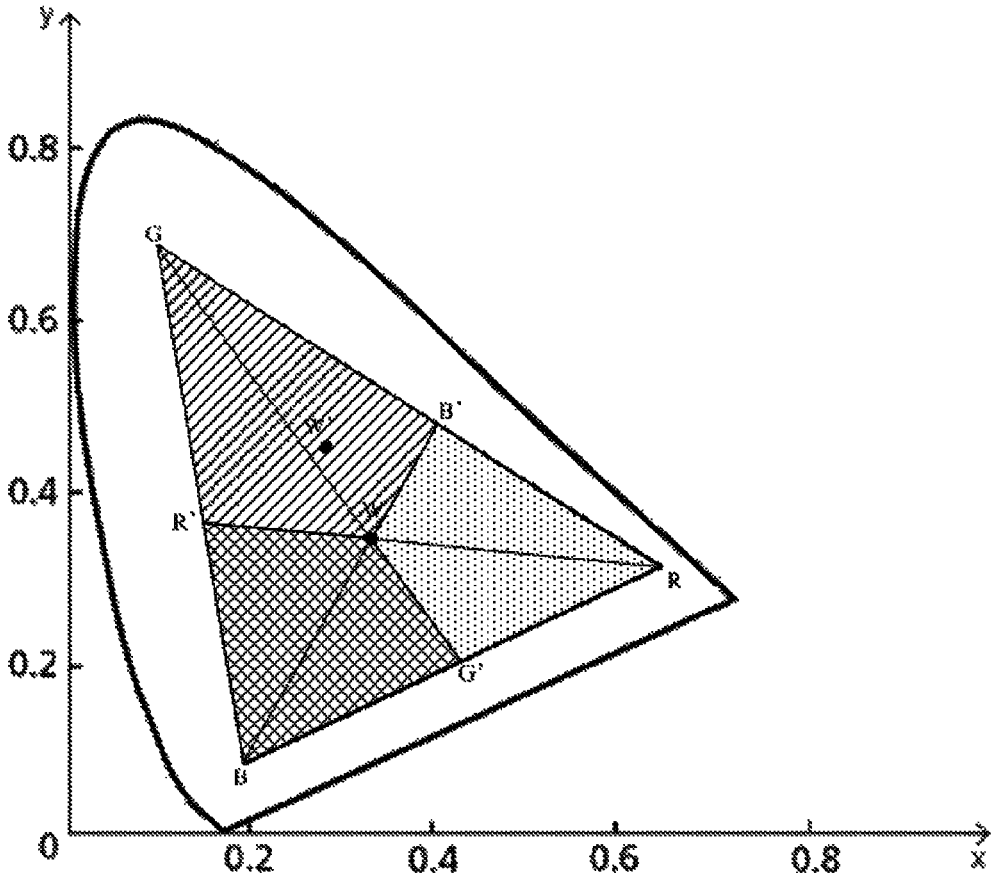
FIG. 4 is a schematic diagram when the color having color cast is W in a chromaticity diagram provided in the embodiment of the present disclosure.

At step S301, RGBW color coordinate values to which the RGBW luminance output values correspond respectively and a W actual color coordinate value are determined, as shown in FIG. 4.

At step S302, position relationship between the W actual color coordinate value and a first region, a second region, a third region in the chromaticity diagram is determined, according to the RGBW color coordinate values and the W actual color coordinate value; that is, it is determined in the chromaticity diagram that the W actual color coordinate value is located in which region among the first region, the second region and the third region in particular.

FIG. 4 is a schematic diagram when the color having color cast is W in a chromaticity diagram provided in the embodiment of the present disclosure.

As shown in FIG. 4, the first region is a region divided by an intersection R' between BG and an extension line from R to W, an intersection B' between RG and an extension line from B to W, and W and G; the second region is a region divided by an intersection G' between BR and an extension line from G to W, an intersection R' between BG and an extension line from R to W, and W and B; the third region is a region divided by an intersection B' between RG and an extension line from B to W, an intersection G' between RB and an extension line from G to W, and W and R.

At step S303, color-cast-removed RGBW luminance output values are determined, respectively, according to the determined position relationship, a preset luminance adjustment coefficient, the W actual color coordinate value, RGBW color coordinate values and a W luminance output value. Wherein the luminance adjustment coefficient is predetermined according to actual requirements; in an implementation, it is possible to improve RGBW luminance output values by changing the magnitude of the luminance adjustment coefficient. In an implementation in practice, a numeric range of the luminance regulating coefficient is generally set between 0.5-2.

In particular, determining the W actual color coordinate value located in which region at step S302 can be realized in the following modes.

(1) in an area method: as for the W actual color coordinate value W', triangle areas $S_{W'R'G'}$, $S_{B'GW'}$, $S_{R'WW'}$, $S_{B'WW'}$ and $S_{R'GB'}$ composed by W'R'G, B'GW', R'WW', B'WW' and R'GB' are calculated respectively, when it is determined that $S_{W'R'G}+S_{B'GW'}+S_{R'WW'}+S_{B'WW'}=S_{R'GB'}$, then it can be determined that the W actual color coordinate value W' is located in the first region; when it is determined that $S_{W'R'G}+S_{B'GW'}+S_{R'WW'}+S_{B'WW'}\neq S_{R'GB'}$, then it can be determined that the W actual color coordinate value W' is located outside the first region.

(2) in an interior angle sum method: as for the W actual color coordinate value W', angles ∠R'W'G, ∠B'W'G, ∠R'W'W and ∠B'W'W are calculated respectively, when it is determined that ∠R'W'G+∠B'W'G+∠R'W'W+∠B'W'W=360°, then it can be determined that the W actual color coordinate value W' is located in the first region; when it is determined that ∠R'W'G+∠B'W'G+∠R'W'W+∠B'W'W≠360°, then it can be determined that the W actual color coordinate value W' is located outside the first region.

The above two modes for implementing the determination at step S302 in which region the W actual color coordinate value is located are only examples. In an implementation in practice, determination of position relationship between the W actual color coordinate value and the regions can be implemented by other manners, no more details discussed here.

In particular, after it is determined at step S302 in which region in particular the W actual color coordinate value is located, step S303 is performed, which includes the following situations in particular: when it is determined that the W luminance output value is located in the first region, setting a G luminance output value in the color-cast-removed RGBW luminance output values as zero; when it is determined that the W luminance output value is located in the second region, setting a B luminance output value in the color-cast-removed RGBW luminance output values as zero; when it is determined that the W luminance output value is located in the third region, setting a R luminance output value in the color-cast-removed RGBW luminance output values as zero, In other words, when a certain luminance output value among RGBW luminance output values is zero, power consumption of a display can be reduced effectively while ensuring no image distortion, thereby a service life of the display can be improved effectively. And when there are only three valid luminance output values among the RGBW luminance output values, power supply for the display can also be effectively reduced in comparison to four valid luminance output values, so that usage cost is reduced.

In particular, at step S303, determining color-cast-removed RGBW luminance output values respectively, according to the determined position relationship, a preset luminance adjustment coefficient, the W actual color coordinate value, RGBW color coordinate values and a W luminance output value comprises the following three situations in particular:

(1) When it is determined that the W luminance output value is located in the first region, the following equations for calculating unknown quantities $L_{r'}$, $L_{w'}$ and $L_{b'}$ can be obtained:

$$L_w = L_{w'} + L_{b'} + L_{r'}$$

$$y_w = \frac{L_{w'} + L_{b'} + L_{r'}}{\frac{L_{w'}}{y_{w'}} + \frac{L_{b'}}{y_b} + \frac{L_{r'}}{y_r}}$$

$$x_w = \frac{\frac{x_{w'}}{y_{w'}} L_{w'} + \frac{x_b}{y_b} L_{b'} + \frac{x_r}{y_r} L_{r'}}{\frac{L_{w'}}{y_{w'}} + \frac{L_{b'}}{y_b} + \frac{L_{r'}}{y_r}}$$

Through converstion of the above equations, the following equations for calculating the color-cast-removed RGBW luminance output values can be obtained:

$$L_{b'} = \left[\frac{1}{y_w} - \left(\frac{x_w}{y_w} - \frac{x_{w'}}{y_{w'}}\right)\frac{y_{w'} - y_r + y_{w'}x_r - x_{w'}y_r}{(x_r y_{w'} - x_{w'} y_r)y_{w'}}\right] * K * L_w$$

$$L_{r'} = \frac{y_{w'} y_r}{y_{w'} - y_r}\left(\frac{1}{y_w} - \frac{1}{y_{w'}}\right) - \left(\frac{1}{y_b} - \frac{1}{y_{w'}}\right)\frac{\left(\frac{x_w}{y_w} - \frac{x_{w'}}{y_{w'}}\right) - \frac{\left(\frac{x_r}{y_r} - \frac{x_{w'}}{y_{w'}}\right)\left(1 - \frac{y_w}{y_{w'}}\right)}{\frac{y_w}{y_r} - \frac{y_w}{y_{w'}}}}{\frac{x_b}{y_b} - \frac{x_{w'}}{y_{w'}} - \frac{y_{w'} y_r}{y_{w'} - y_r} * \left(\frac{1}{y_b} - \frac{1}{y_{w'}}\right)\left(\frac{x_r}{y_r} - \frac{x_{w'}}{y_{w'}}\right)} * K * L_w$$

$$L_{w'} = K * (L_w - L_{b'} - L_{r'})$$

$$L_{g'} = 0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

(2) When it is determined that the W luminance output value is located in the second region, the following equations for calculating unknown quantities $L_{r'}$, $L_{w'}$ and $L_{g'}$ can be obtained:

$$L_w = L_{w'} + L_{g'} + L_{r'}$$

$$y_w = \frac{L_{w'} + L_{g'} + L_{r'}}{\frac{L_{w'}}{y_{w'}} + \frac{L_{g'}}{y_g} + \frac{L_{r'}}{y_r}}$$

$$x_w = \frac{\frac{x_{w'}}{y_{w'}} L_{w'} + \frac{x_g}{y_g} L_{g'} + \frac{x_r}{y} L_{r'}}{\frac{L_{w'}}{y_{w'}} + \frac{L_{g'}}{y_g} + \frac{L_{r'}}{y_r}}$$

Through converstion of the above equations, the following equations for calculating the color-cast-removed RGBW luminance output values can be obtained:

$$L_{r'} = \left[\frac{1}{y_w} - \left(\frac{x_w}{y_w} - \frac{x_{w'}}{y_{w'}}\right)\frac{y_{w'} - y_g + y_{w'}x_g - x_{w'}y_g}{(x_g y_{w'} - x_{w'} y_g)y_{w'}}\right] * K * L_w$$

$$L_{w'} = K * (L_w - L_{r'} - L_{g'})$$

$$L_{b'} = 0$$

$$L_{g'} = \frac{y_{w'} y_g}{y_{w'} - y_g}\left(\frac{1}{y_w} - \frac{1}{y_{w'}}\right) - \left(\frac{1}{y_r} - \frac{1}{y_{w'}}\right)\frac{\left(\frac{x_w}{y_w} - \frac{x_{w'}}{y_{w'}}\right) - \frac{\left(\frac{x_g}{y_g} - \frac{x_{w'}}{y_{w'}}\right)\left(1 - \frac{y_w}{y_{w'}}\right)}{\frac{y_w}{y_g} - \frac{y_w}{y_{w'}}}}{\frac{x_r}{y_r} - \frac{x_{w'}}{y_{w'}} - \frac{y_{w'} y_g}{y_{w'} - y_g} * \left(\frac{1}{y_r} - \frac{1}{y_{w'}}\right)\left(\frac{x_g}{y_g} - \frac{x_{w'}}{y_{w'}}\right)} * K * L_w$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

(3) When it is determined that the W luminance output value is located in the third region, the following equations for calculating unknown quantities $L_{g'}$, $L_{w'}$ and $L_{b'}$ can be obtained:

$$L_w = L_{w'} + L_{b'} + L_{g'}$$

$$y_w = \frac{L_{w'} + L_{b'} + L_{g'}}{\frac{L_{w'}}{y_{w'}} + \frac{L_{b'}}{y_b} + \frac{L_{g'}}{y_g}}$$

$$x_w = \frac{\frac{x_{w'}}{y_{w'}} L_{w'} + \frac{x_b}{y_b} L_{b'} + \frac{x_g}{y_g} L_{g'}}{\frac{L_{w'}}{y_{w'}} + \frac{L_{b'}}{y_b} + \frac{L_{g'}}{y_g}}$$

Through converstion of the above equations, the following equations for calculating the color-cast-removed RGBW luminance output values can be obtained:

$$L_{b'} = \left[\frac{1}{y_w} - \left(\frac{x_w}{y_w} - \frac{x_{w'}}{y_{w'}}\right)\frac{y_{w'} - y_g + y_{w'}x_g - x_{w'}y_g}{(x_g y_{w'} - x_{w'} y_g)y_{w'}}\right] * K * L_w$$

$$L_{g'} = \frac{y_{w'}y_g}{y_{w'} - y_g}\left[\left(\frac{1}{y_w} - \frac{1}{y_{w'}}\right) - \left(\frac{1}{y_b} - \frac{1}{y_{w'}}\right)\frac{\left(\frac{x_w}{y_w} - \frac{x_{w'}}{y_{w'}}\right) - \frac{\left(\frac{x_g}{y_g} - \frac{x_{w'}}{y_{w'}}\right)\left(1 - \frac{y_w}{y_{w'}}\right)}{\frac{y_w}{y_g} - \frac{y_w}{y_{w'}}}}{\frac{x_b}{y_b} - \frac{x_{w'}}{y_{w'}} - \frac{y_{w'}y_g}{y_{w'} - y_g} * \left(\frac{1}{y_b} - \frac{1}{y_{w'}}\right)\left(\frac{x_g}{y_g} - \frac{x_{w'}}{y_{w'}}\right)}\right] * K * L_w$$

$$L_{w'} = K * (L_w - L_{b'} - L_{g'})$$

$$L_{r'} = 0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In an implementation in practice, the RGBW luminance output values in the three situations can be calculated through the above specific computation equations, or other equations, the present disclosure makes no limitation thereto.

Second Case: by an actual measurement, it is obtained that the color having color shifting among RGBW is only R, that is, it is determined that the the color having monochromatic color cast among RGBW is R.

Figure 5:
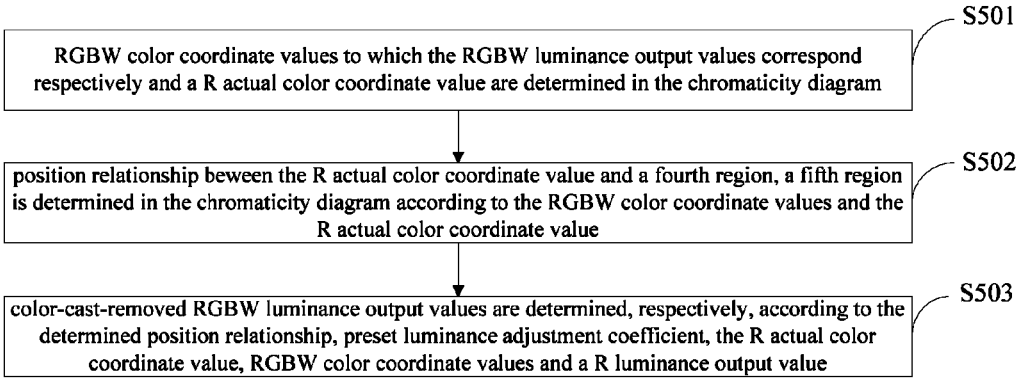
FIG. 5 is a flowchart of the method for image conversion from RGB signals into RGBW signals when a color having color cast is R provided in the embodiment of the present disclosure.

FIG. 5 is a flowchart of the method for image conversion from RGB signals into RGBW signals when a color having color cast is R provided in the embodiment of the present disclosure.

In particular, at step S103 of the method for image conversion provided in the embodiment of the present disclosure, determining color-cast-removed RGBW luminance output values respectively, according to the position relationship between RGBW color coordinate values to which the RGBW luminance output values correspond respectively and the predetermined actual color coordinate value of the color having monochromatic color cast among RGBW in the chromaticity diagram can be realized by the following steps, as shown in FIG. 5.

Figure 6:
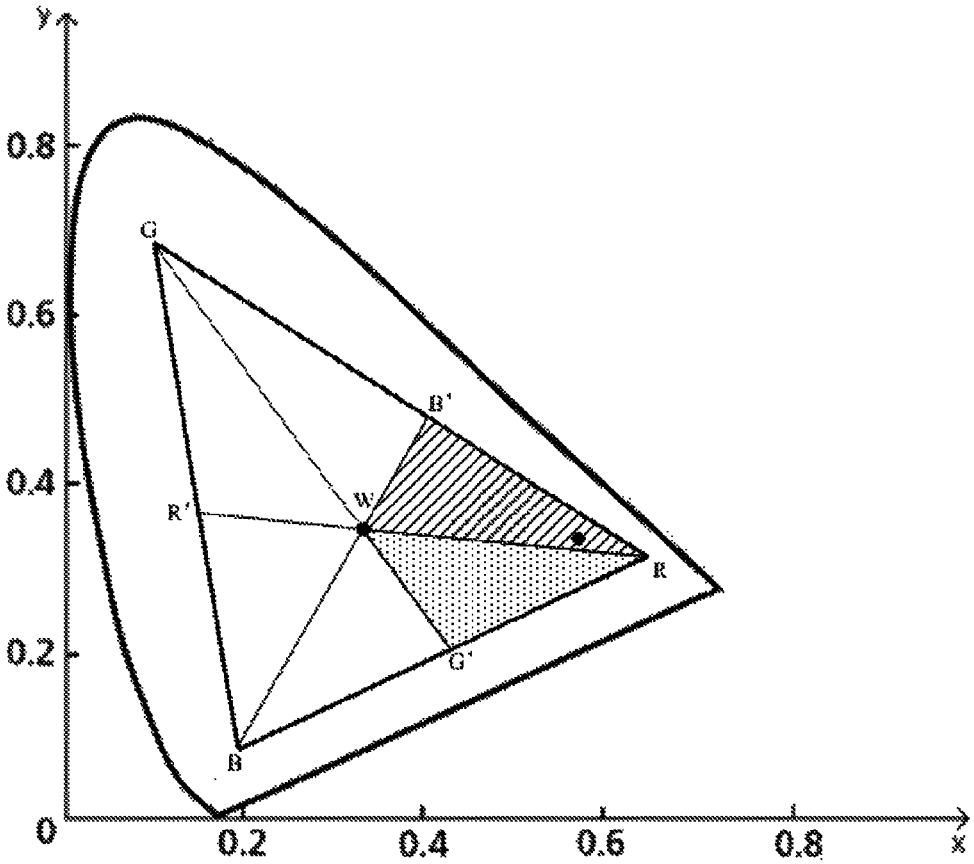
FIG. 6 is a schematic diagram when the color having color cast is R in a chromaticity diagram provided in the embodiment of the present disclosure.

At step S501, RGBW color coordinate values to which the RGBW luminance output values correspond respectively and a R actual color coordinate value is determined in the chromaticity diagram, as shown in FIG. 6.

FIG. 6 is a schematic diagram when the color having color cast is R in a chromaticity diagram provided in the embodiment of the present disclosure.

At step S502, position relationship between the R actual color coordinate value and a fourth region, a fifth region is determined in the chromaticity diagram according to the RGBW color coordinate values and the R actual color coordinate value. That is, it is determined in the chromaticity diagram that the R actual color coordinate value is located in the fourth region or the fifth region; wherein, as shown in FIG. 6, the fourth region is a region divided by an intersection G' between BR and an extension line from G to W, and W and R; the fifth region is a region divided by an intersection B' between GR and an extension line from B to W, and W and R.

In an implementation in practice, the area method and the interior angle sum method and other methods, which are the same as those in the First Case, can be adopted to determine the position relationship between the R actual color coordinate value and the regions, no more details discussed here.

At step S503, color-cast-removed RGBW luminance output values are determined, respectively, according to the determined position relationship, preset luminance adjustment coefficient, the R actual color coordinate value, RGBW color coordinate values and a R luminance output value. Wherein the luminance adjustment coefficient is predetermined according to actual requirements; in an implementation, it is possible to improve RGBW luminance output values by changing the magnitude of the luminance adjustment coefficient. In an implementation in practice, a numeric range of the luminance regulating coefficient is generally set between 0.5-2.

In particular, after it is determined at step S502 in which region in particular the R actual color coordinate value is located, step S503 is to be executed, which specifically comprises the following situations: when it is determined that the R luminance output value is located in the fourth region, setting a G luminance output value in the color-cast-removed RGBW luminance output values as zero; when it is determined that the R luminance output value is located in the fifth region, setting a B luminance output value in the color-cast-removed RGBW luminance output values as zero. In other words, when a certain luminance output value among RGBW luminance output values is zero, power consumption of a display can be reduced effectively while ensuring no image distortion, thereby a service life of the display can be improved effectively. And when there are only three valid luminance output values among the RGBW luminance output values, power supply for the display can also be effectively reduced in comparison to four valid luminance output values, so that usage cost is reduced.

In particular, at step S503, determining color-cast-removed RGBW luminance output values respectively, according to the determined position relationship, the preset luminance adjustment coefficient, the R actual color coordinate value, RGBW color coordinate values and the R luminance output value comprises the following two situations in particular:

(1) When it is determined that the R luminance output value is located in the fourth region, the following equations for calculating unknown quantities $L_{r'}$, $L_{w'}$ and $L_{b'}$ can be obtained:

$$L_r = L_{w'} + L_{b'} + L_{r'}$$

$$y_r = \frac{L_{w'} + L_{b'} + L_{r'}}{\frac{L_{w'}}{y_w} + \frac{L_{b'}}{y_b} + \frac{L_{r'}}{y_{r'}}}$$

-continued $$x_r = \frac{\frac{x_w}{y_w}L_{w'} + \frac{x_b}{y_b}L_{b'} + \frac{x_{r'}}{y_{r'}}L_{r'}}{\frac{L_{w'}}{y_w} + \frac{L_{b'}}{y_b} + \frac{L_{r'}}{y_{r'}}}$$

Through converstion of the above equations, the following equations for calculating the color-cast-removed RGBW luminance output values can be obtained:

$$L_{r'} = (L_{b'} + L_{w'} + L_r) * K$$

$$L_{b'} = \frac{y_b}{y_r} * \frac{(y_w - y_{r'})(x_r - x_{r'}) - y_w(y_r - y_{r'})(x_w - x_{r'})}{(y_w - y_{r'})(x_{r'} - x_b) - y_w(y_b - y_{r'})(x_{r'} - x_w)} * K * L_r$$

$$L_{w'} = \frac{y_w}{y_r} * \left[\frac{y_{r'} - y_r}{y_w - y_{r'}} - \frac{y_b - y_{r'}}{y_w - y_{r'}} * \frac{(y_w - y_{r'})(x_r - x_{r'}) - y_w(y_r - y_{r'})(x_w - x_{r'})}{(y_w - y_{r'})(x_{r'} - x_b) - y_w(y_b - y_{r'})(x_{r'} - x_w)}\right] * K * L_r$$

$$L_{g'} = 0$$

where $L_{r'}$, $L_{g'}$, $L_{b'}$ and $L_{w'}$ represent the color-cast-removed RGBW luminance output values respectively; $L_r$ represents the R luminance output value; K represents the luminance adjustment coefficient; $(x_{r'}, y_{r'})$ represents the R actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

(2) When it is determined that the R luminance output value is located in the fifth region, the following equations for calculating unknown quantities $L_{r'}$, $L_{w'}$ and $L_{g'}$ can be obtained:

$$L_r = L_{w'} + L_{g'} + L_{r'}$$

$$y_r = \frac{L_{w'} + L_{g'} + L_{r'}}{\frac{L_{w'}}{y_w} + \frac{L_{g'}}{y_g} + \frac{L_{r'}}{y_{r'}}}$$

$$x_r = \frac{\frac{x_w}{y_w}L_{w'} + \frac{x_g}{y_g}L_{g'} + \frac{x_{r'}}{y_{r'}}L_{r'}}{\frac{L_{w'}}{y_w} + \frac{L_{g'}}{y_g} + \frac{L_{r'}}{y_{r'}}}$$

Through converstion of the above equations, the following equations for calculating the color-cast-removed RGBW luminance output values can be obtained:

$$L_{r'} = (L_{g'} + L_{w'} + L_r) * K$$

$$L_{g'} = \frac{y_g}{y_r} * \frac{(y_w - y_{r'})(x_r - x_{r'}) - y_w(y_r - y_{r'})(x_w - x_{r'})}{(y_w - y_{r'})(x_{r'} - x_g) - y_w(y_g - y_{r'})(x_{r'} - x_w)} * K * L_r$$

$$L_{w'} = \frac{y_w}{y_r} * \left[\frac{y_{r'} - y_r}{y_w - y_{r'}} - \frac{y_g - y_{r'}}{y_w - y_{r'}} * \frac{(y_w - y_{r'})(x_r - x_{r'}) - y_w(y_r - y_{r'})(x_w - x_{r'})}{(y_w - y_{r'})(x_{r'} - x_g) - y_w(y_g - y_{r'})(x_{r'} - x_w)}\right] * K * L_r$$

$$L_{b'} = 0$$

where $L_{r'}$, $L_{g'}$, $L_{b'}$ and $L_{w'}$ represent the color-cast-removed RGBW luminance output values respectively; $L_r$ represents the R luminance output value; K represents the luminance adjustment coefficient; $(x_{r'}, y_{r'})$ represents the R actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In an implementation in practice, the RGBW luminance output values in the two situations can be calculated through the above specific computation equations, or other equations, the present disclosure makes no limitation thereto.

Third Case: by an actual measurement, it is obtained that the color having color shifting among RGBW is only G, that is, it is determined that the the color having monochromatic color cast among RGBW is G.

Figure 7:
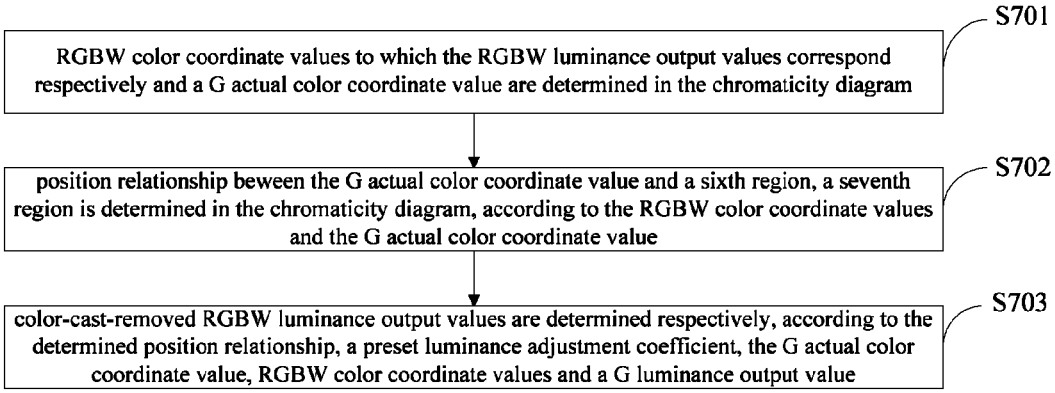
FIG. 7 is a flowchart of the method for image conversion from RGB signals into RGBW signals when a color having color cast is G provided in the embodiment of the present disclosure.

FIG. 7 is a flowchart of the method for image conversion from RGB signals into RGBW signals when a color having color cast is G provided in the embodiment of the present disclosure.

In particular, at step S103 of the method for image conversion provided in the embodiment of the present disclosure, determining color-cast-removed RGBW luminance output values respectively, according to the position relationship between RGBW color coordinate values to which the RGBW luminance output values correspond respectively and the predetermined actual color coordinate value of the color having monochromatic color cast among RGBW in the chromaticity diagram can be realized by the following steps, as shown in FIG. 7.

Figure 8:
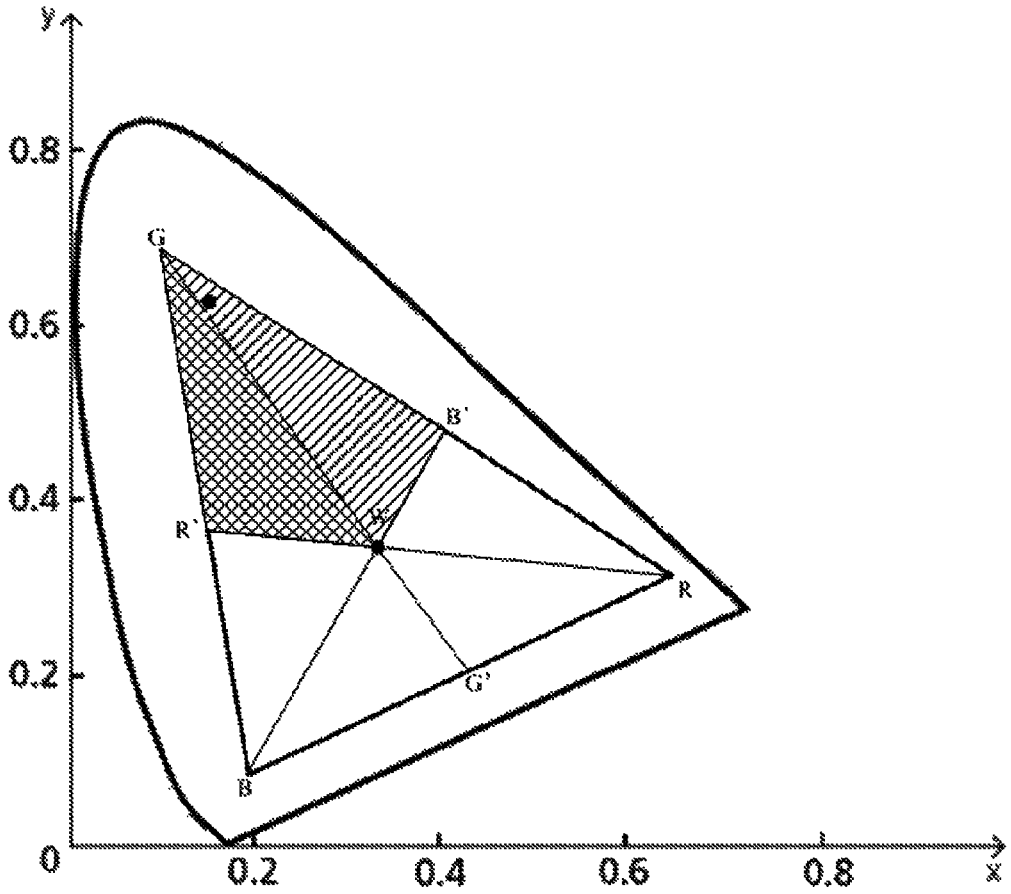
FIG. 8 is a schematic diagram when the color having color cast is G in a chromaticity diagram provided in the embodiment of the present disclosure.

At step S701, RGBW color coordinate values to which the RGBW luminance output values correspond respectively and a G actual color coordinate value is determined, as shown in FIG. 8.

FIG. 8 is a schematic diagram when the color having color cast is G in a chromaticity diagram provided in the embodiment of the present disclosure.

At step S702, position relationship between the G actual color coordinate value and a sixth region, a seventh region is determined in the chromaticity diagram, according to the RGBW color coordinate values and the G actual color coordinate value. That is, it is determined in the chromaticity diagram that the G actual color coordinate value is located in the sixth region or the seventh region; wherein, as shown in FIG. 8, the sixth region is a region divided by an intersection R' between BG and an extension line from R to W, and W and G; the seventh region is a region divided by an intersection B' between GR and an extension line from B to W, and W and G.

In an implementation in practice, the area method and the interior angle sum method and other methods, which are the same as those in the First Case, can be adopted to determine the position relationship between the G actual color coordinate value and the regions, no more details discussed here.

At step S703, color-cast-removed RGBW luminance output values are determined, respectively, according to the determined position relationship, a preset luminance adjustment coefficient, the G actual color coordinate value, RGBW color coordinate values and a G luminance output value. Wherein the luminance adjustment coefficient is predetermined according to actual requirements; in an implementation, it is possible to improve RGBW luminance output values by changing the magnitude of the luminance adjustment coefficient. In an implementation in practice, a numeric range of the luminance regulating coefficient is generally set between 0.5-2.

In particular, after it is determined at step S702 in which region in particular the G actual color coordinate value is located, step S703 is performed, which includes the following situations in particular: when it is determined that the G luminance output value is located in the sixth region, setting a R luminance output value in the color-cast-removed RGBW luminance output values as zero; when it is determined that the G luminance output value is located in the seventh region, setting a B luminance output value in the color-cast-removed RGBW luminance output values as zero. In other words, when a certain luminance output value among RGBW luminance output values is zero, power consumption of a display can be reduced effectively while ensuring no image distortion, thereby a service life of the display can be improved effectively. And when there are only three valid luminance output values among the RGBW luminance output values, power supply for the display can also be effectively reduced in comparison to four valid luminance output values, so that usage cost is reduced.

In particular, at step S703, determining color-cast-removed RGBW luminance output values respectively, according to the determined position relationship, the preset luminance adjustment coefficient, the G actual color coordinate value, RGBW color coordinate values and the G luminance output value, comprises the following two situations in particular:

(1) When it is determined that the G luminance output value is located in the sixth region, the following equations for calculating unknown quantities $L_{g'}$, $L_{w'}$ and $L_{b'}$ can be obtained:

$$L_g = L_{w'} + L_{g'} + L_{b'}$$

$$y_g = \frac{L_{w'} + L_{g'} + L_{b'}}{\frac{L_{w'}}{y_w} + \frac{L_{g'}}{y_{g'}} + \frac{L_{b'}}{y_b}}$$

$$x_g = \frac{\frac{x_w}{y_w}L_{w'} + \frac{x_{g'}}{y_{g'}}L_{g'} + \frac{x_b}{y_b}L_{b'}}{\frac{L_{w'}}{y_w} + \frac{L_{g'}}{y_{g'}} + \frac{L_{b'}}{y_b}}$$

Through converstion of the above equations, the following equations for calculating the color-cast-removed RGBW luminance output values can be obtained:

$$L_{g'} = (L_g + L_{w'} + L_{b'}) * K$$

$$L_{b'} = \frac{y_b}{y_g} * \frac{(y_w - y_{g'})(x_g - x_{g'}) - y_w(y_b - y_{g'})(x_w - x_{g'})}{(y_w - y_{g'})(x_{g'} - x_g) - y_w(y_g - y_{g'})(x_{g'} - x_w)} * K * L_g$$

$$L_{w'} = \frac{y_w}{y_g} * \left[ \frac{y_{g'} - y_b}{y_w - y_{g'}} - \frac{y_g - y_{g'}}{y_w - y_{g'}} * \frac{\begin{array}{c}(y_w - y_{g'})(x_b - x_{g'}) - \\ y_w(y_b - y_{g'})(x_w - x_{g'})\end{array}}{\begin{array}{c}(y_w - y_{g'})(x_{g'} - x_b) - \\ y_w(y_g - y_{g'})(x_{g'} - x_w)\end{array}} \right] * K * L_g$$

$$L_{r'} = 0$$

where $L_{r'}$, $L_{g'}$, $L_{b'}$ and $L_{w'}$ represent the color-cast-removed RGBW luminance output values respectively; $L_g$ represents the G luminance output value; K represents the luminance adjustment coefficient; $(x_{g'}, y_{g'})$ represents the G actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

(2) When it is determined that the G luminance output value is located in the seventh region, the following equations for calculating unknown quantities $L_{g'}$, $L_{w'}$ and $L_{r'}$ can be obtained:

$$L_g = L_{w'} + L_{g'} + L_{r'}$$

$$y_g = \frac{L_{w'} + L_{g'} + L_{r'}}{\frac{L_{w'}}{y_w} + \frac{L_{g'}}{y_{g'}} + \frac{L_{r'}}{y_r}}$$

$$x_g = \frac{\frac{x_w}{y_w}L_{w'} + \frac{x_{g'}}{y_{g'}}L_{g'} + \frac{x_r}{y_r}L_{r'}}{\frac{L_{w'}}{y_w} + \frac{L_{g'}}{y_{g'}} + \frac{L_{r'}}{y_r}}$$

Through converstion of the above equations, the following equations for calculating the color-cast-removed RGBW luminance output values can be obtained:

$$L_{g'} = (L_g + L_{w'} + L_{r'}) * K$$

$$L_{r'} = \frac{y_r}{y_g} * \frac{(y_w - y_{g'})(x_g - x_{g'}) - y_w(y_r - y_{g'})(x_w - x_{g'})}{(y_w - y_{g'})(x_{g'} - x_g) - y_w(y_g - y_{g'})(x_{g'} - x_w)} * K * L_g$$

$$L_{w'} = \frac{y_w}{y_g} * \left[ \frac{y_{g'} - y_r}{y_w - y_{g'}} - \frac{y_g - y_{g'}}{y_w - y_{g'}} * \frac{\begin{array}{c}(y_w - y_{g'})(x_r - x_{g'}) - \\ y_w(y_r - y_{g'})(x_w - x_{g'})\end{array}}{\begin{array}{c}(y_w - y_{g'})(x_{g'} - x_b) - \\ y_w(y_g - y_{g'})(x_{g'} - x_w)\end{array}} \right] * K * L_g$$

$$L_{b'} = 0$$

where $L_{r'}$, $L_{g'}$, $L_{b'}$ and $L_{w'}$ represent the color-cast-removed RGBW luminance output values respectively; $L_g$ represents the G luminance output value; K represents the luminance adjustment coefficient; $(x_{g'}, y_{g'})$ represents the G actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In an implementation in practice, the RGBW luminance output values in the two situations can be calculated through the above specific computation equations, or other equations, the present disclosure makes no limitation thereto.

Fourth Case: by an actual measurement, it is obtained that the color having color shifting among RGBW is only B, that is, it is determined that the the color having monochromatic color cast among RGBW is B.

Figure 9:
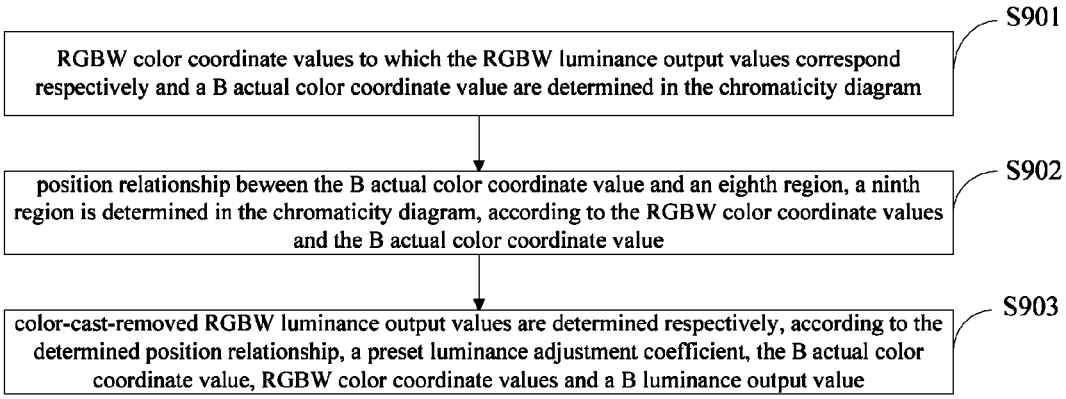
FIG. 9 is a flowchart of the method for image conversion from RGB signals into RGBW signals when a color having color cast is B provided in the embodiment of the present disclosure.

FIG. 9 is a flowchart of the method for image conversion from RGB signals into RGBW signals when a color having color cast is B provided in the embodiment of the present disclosure.

In particular, at step S103 of the method for image conversion provided in the embodiment of the present disclosure, determining color-cast-removed RGBW luminance output values respectively, according to the position relationship between RGBW color coordinate values to which the RGBW luminance output values correspond respectively and the predetermined actual color coordinate value of the color having monochromatic color cast among RGBW in the chromaticity diagram can be realized by the following steps, as shown in FIG. 9.

Figure 10:
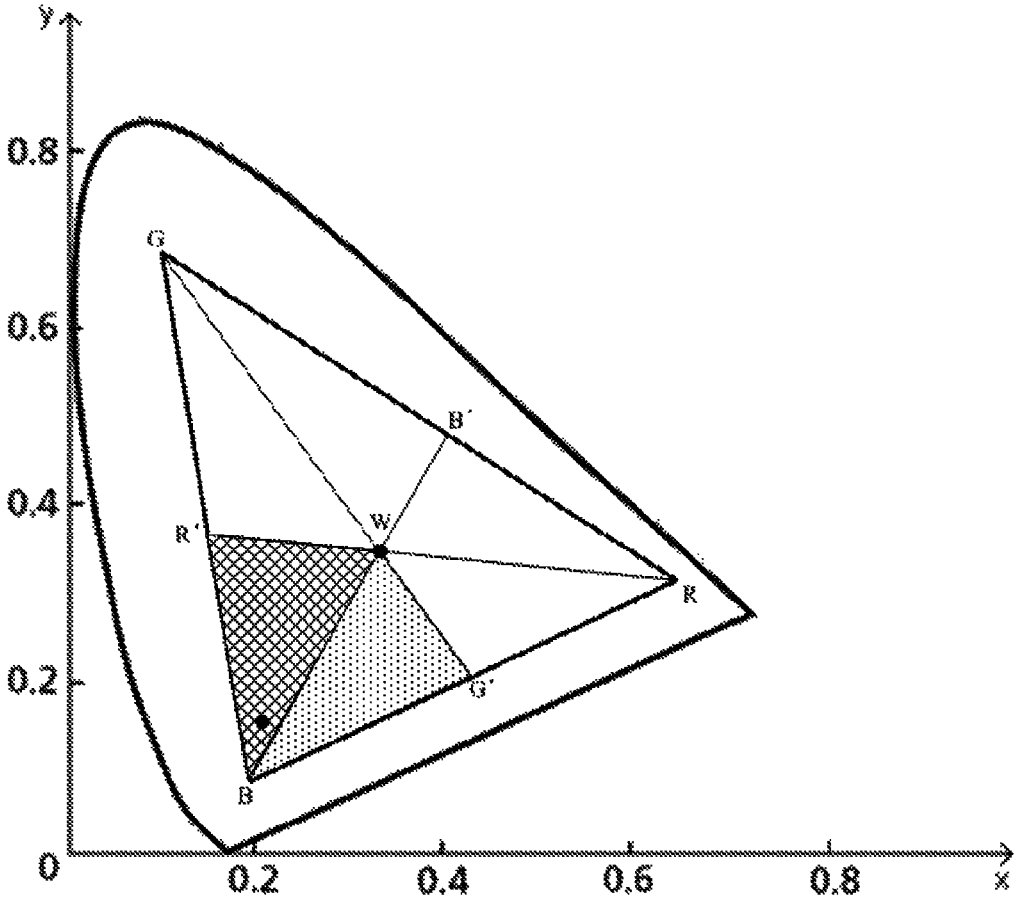
FIG. 10 is a schematic diagram when the color having color cast is B in a chromaticity diagram provided in the embodiment of the present disclosure.

At step S901, RGBW color coordinate values to which the RGBW luminance output values correspond respectively and a B actual color coordinate value are determined in the chromaticity diagram, as shown in FIG. 10.

FIG. 10 is a schematic diagram when the color having color cast is B in a chromaticity diagram provided in the embodiment of the present disclosure.

At step S902, position relationship between the B actual color coordinate value and an eighth region, a ninth region is determined in the chromaticity diagram, according to the RGBW color coordinate values and the B actual color coordinate value. That is, it is determined in the chromaticity diagram that the B actual color coordinate value is located in the eighth region or the ninth region; wherein, as shown in FIG. 10, the eighth region is a region divided by an intersection R' between BG and an extension line from R to W, and W and B; the ninth region is a region divided by an intersection G' between BR and an extension line from G to W, and W and B.

In an implementation in practice, the area method and the interior angle sum method and other methods, which are the same as those in the First Case, can be adopted to determine the position relationship between the B actual color coordinate value and the regions, no more details discussed here.

At step S903, color-cast-removed RGBW luminance output values are determined, respectively, according to the determined position relationship, a preset luminance adjustment coefficient, the B actual color coordinate value, RGBW color coordinate values and a B luminance output value. Wherein the luminance adjustment coefficient is predetermined according to actual requirements; in an implementation, it is possible to improve RGBW luminance output values by changing the magnitude of the luminance adjustment coefficient. In an implementation in practice, a numeric range of the luminance regulating coefficient is generally set between 0.5-2.

In particular, after it is determined at step S902 that in which region in particular the B actual color coordinate value is located, step S903 is performed, which includes the following situations in particular: when it is determined that the B luminance output value is located in the eighth region, setting a R luminance output value in the color-cast-removed RGBW luminance output values as zero; when it is determined that the B luminance output value is located in the ninth region, setting a G luminance output value in the color-cast-removed RGBW luminance output values as zero. In other words, when a certain luminance output value among RGBW luminance output values is zero, power consumption of a display can be reduced effectively while ensuring no image distortion, thereby a service life of the display can be improved effectively. And when there are only three valid luminance output values among the RGBW luminance output values, power supply for the display can also be effectively reduced in comparison to four valid luminance output values, so that usage cost is reduced.

In particular, at step S903, determining color-cast-removed RGBW luminance output values respectively, according to the determined position relationship, the preset luminance adjustment coefficient, the B actual color coordinate value, RGBW color coordinate values and a B luminance output value comprises the following two situations in particular:

(1) When it is determined that the B luminance output value is located in the eighth region, the following equations for calculating unknown quantities $L_{g'}$, $L_{w'}$ and $L_{b'}$ can be obtained:

$$L_b = L_{w'} + L_{g'} + L_{b'}$$

$$y_b = \frac{L_{w'} + L_{g'} + L_{b'}}{\frac{L_{w'}}{y_w} + \frac{L_{g'}}{y_g} + \frac{L_{b'}}{y_{b'}}}$$

-continued $$x_b = \frac{\frac{x_w}{y_w}L_{w'} + \frac{x_g}{y_g}L_{g'} + \frac{x_{b'}}{y_{b'}}L_{b'}}{\frac{L_{w'}}{y_w} + \frac{L_{g'}}{y_g} + \frac{L_{b'}}{y_{b'}}}$$

Through converstion of the above equations, the following equations for calculating the color-cast-removed RGBW luminance output values can be obtained:

$$L_{b'} = (L_b + L_{w'} + L_{g'}) * K$$

$$L_{g'} = \frac{y_g}{y_b} * \frac{(y_w - y_{g'})(x_g - x_{g'}) - y_w(y_g - y_{g'})(x_w - x_{g'})}{(y_w - y_{g'})(x_{g'} - x_g) - y_w(y_g - y_{g'})(x_{g'} - x_w)} * K * L_b$$

$$L_{w'} = \frac{y_w}{y_g} * \left[\frac{y_{g'} - y_g}{y_w - y_{g'}} - \frac{y_g - y_{g'}}{y_w - y_{g'}} * \frac{(y_w - y_{g'})(x_g - x_{g'}) - y_w(y_g - y_{g'})(x_w - x_{g'})}{(y_w - y_{g'})(x_{g'} - x_b) - y_w(y_g - y_{g'})(x_{g'} - x_w)}\right] * K * L_b$$

$$L_{r'} = 0$$

where $L_{r'}$, $L_{g'}$, $L_{b'}$ and $L_{w'}$ represent the color-cast-removed RGBW luminance output values respectively; $L_b$ represents the B luminance output value; K represents the luminance adjustment coefficient; $(x_{b'}, y_{b'})$ represents the B actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

(2) When it is determined that the B luminance output value is located in the ninth region, the following equations for calculating unknown quantities $L_{r'}$, $L_{w'}$ and $L_{b'}$ can be obtained:

$$L_b = L_{w'} + L_{b'} + L_{r'}$$

$$y_b = \frac{L_{w'} + L_{b'} + L_{r'}}{\frac{L_{w'}}{y_w} + \frac{L_{b'}}{y_{b'}} + \frac{L_{r'}}{y_r}}$$

$$x_b = \frac{\frac{x_w}{y_w}L_{w'} + \frac{x_{b'}}{y_{b'}}L_{b'} + \frac{x_r}{y_r}L_{r'}}{\frac{L_{w'}}{y_w} + \frac{L_{b'}}{y_{b'}} + \frac{L_{r'}}{y_r}}$$

Through converstion of the above equations, the following equations for calculating the color-cast-removed RGBW luminance output values can be obtained:

$$L_{b'} = (L_b + L_w + L_r) * K$$

$$L_{r'} = \frac{y_r}{y_b} * \frac{(y_w - y_{b'})(x_r - x_{b'}) - y_w(y_r - y_{b'})(x_w - x_{b'})}{(y_w - y_{b'})(x_{b'} - x_r) - y_w(y_r - y_{b'})(x_{b'} - x_w)} * K * L_b$$

$$L_{w'} = \frac{y_w}{y_b} * \left[\frac{y_{b'} - y_r}{y_w - y_{b'}} - \frac{y_r - y_{b'}}{y_w - y_{b'}} * \frac{(y_w - y_{b'})(x_r - x_{b'}) - y_w(y_r - y_{b'})(x_w - x_{b'})}{(y_w - y_{b'})(x_{b'} - x_g) - y_w(y_r - y_{b'})(x_{b'} - x_w)}\right] * K * L_b$$

$$L_{g'} = 0$$

where $L_{r'}$, $L_{g'}$, $L_{b'}$ and $L_{w'}$ represent the color-cast-removed RGBW luminance output values respectively; $L_b$ represents the B luminance output value; K represents the luminance adjustment coefficient; $(x_{b'}, y_{b'})$ represents the B actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

In an implementation in practice, the RGBW luminance output values in the two situations can be calculated through the above specific computation equations, or other equations, the present disclosure makes no limitation thereto.

In particular, at step S104 in the method for image conversion provided in the embodiment of the present disclosure, the color-cast-removed RGBW luminance output values are converted into corresponding RGBW output signals and outputed, in an implementation, it can be realized by an inverse-gramma conversion manner, that is, the color-cast-removed RGBW luminance output values can be converted into corresponding RGBW output signals by the following equations:

$$R_0 = \left(\frac{L_{R'}}{L_{Rmax}}\right)^{\frac{1}{\gamma}} \times 255;\ G_0 = \left(\frac{L_{G'}}{L_{Gmax}}\right)^{\frac{1}{\gamma}} \times 255;\ B_0 = \left(\frac{L_{B'}}{L_{Bmax}}\right)^{\frac{1}{\gamma}} \times 255;$$

$$W_0 = \left(\frac{L_{W'}}{L_{Wmax}}\right)^{\frac{1}{\gamma}} \times 255;$$

where $L_{R'}$ represents a red luminance output value in the RGBW luminance output values, $L_{G'}$ represents a green luminance output value in the RGBW luminance output values, $L_{B'}$ represents a blue luminance output value in the RGBW luminance output values, $L_{W'}$ represents a white luminance output value in the RGBW luminance output values; $R_0$ represents a red output signal value in the RGBW output signals, $G_0$ represents a blue output signal value in the RGBW output signals, $B_0$ represents a green output signal value in the RGBW output signals; $L_{Rmax}$ represents a red maximum luminance value, $L_{Gmax}$ represents a green maximum luminance value, $L_{Bmax}$ represents a blue maximum luminance value; $L_{Wmax}$ represents a white maximum luminance value; $\gamma$ represents a gamma conversion factor.

Typically, in a specific computation, the gamma conversion factor $\gamma$ is usually set as 2.2.

Based on the same inventive concept, an embodiment of the present disclosure also provides a device for image conversion from RGB signals into RGBW signals, since the principles by which the device solves the problem are the same as those of the method for image conversion from RGB signals into RGBW signals described above, implementations of the method can be consulted for implementations of the device, no more details discussed here.

Figure 11:
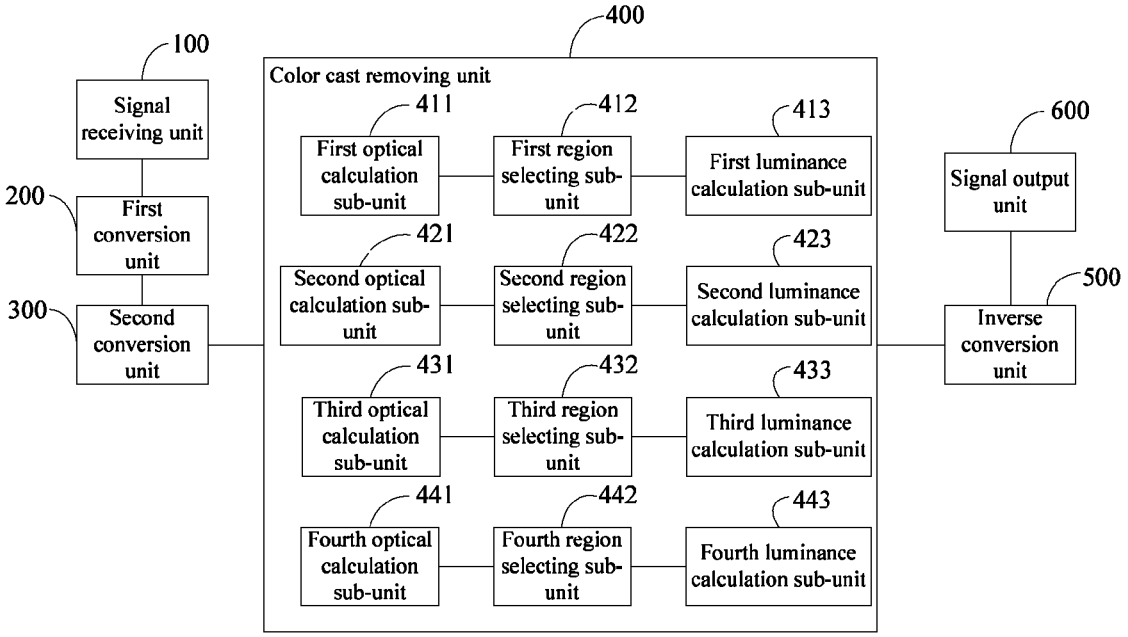
FIG. 11 is structural schematic diagram of the device for image conversion from RGB signals into RGBW signals provided by an embodiment of the present disclosure.

FIG. 11 is structural schematic diagram of the device for image conversion from RGB signals into RGBW signals provided in the embodiment of the present disclosure. As shown in FIG. 11, the device for image conversion comprises: a signal receiving unit 100 configured to receive RGB input signals; a first conversion unit 200 configured to convert received RGB input signals into corresponding RGB luminance input values, respectively; a second conversion unit 300 configured to convert the RGB luminance input values into RGBW luminance output values; a color cast removing unit 400 configured to determine color-cast-removed RGBW luminance output values respectively, according to a position relationship between RGBW color coordinate values to which the RGBW luminance output values correspond respectively and a predetermined actual color coordinate value of a color having monochromatic color cast among RGBW in a chromaticity diagram; an inverse conversion unit 500 configured to convert the color-cast-removed RGBW luminance output values into corresponding RGBW output signals; a signal output unit 600 configured to output the RGBW output signals.

Further, as shown in FIG. 11, the color cast removing unit 400 in the device for image conversion provided in the embodiment of the present disclosure specifically comprises: a first optical calculation sub-unit 411 configured to when it is determined that the color having monochromatic color cast among RGBW is W, determine, in the chromaticity diagram, RGBW color coordinate values to which the RGBW luminance output values correspond respectively and a W actual color coordinate value; a first region selecting sub-unit 412 configured to determine in the chromaticity diagram position relationship between the W actual color coordinate value and a first region, a second region, a third region, according to the RGBW color coordinate values and the W actual color coordinate value; the first region being a region divided by an intersection between BG and an extension line from R to W, an intersection between RG and an extension line from B to W, and W and G; the second region being a region divided by an intersection between BR and an extension line from G to W, an intersection between BG and an extension line from R to W, and W and B; the third region being a region divided by an intersection between RG and an extension line from B to W, an intersection between RB and an extension line from G to W, and W and R; a first luminance calculation sub-unit 413 configured to determine color-cast-removed RGBW luminance output values respectively, according to the determined position relationship, a preset luminance adjustment coefficient, the W actual color coordinate value, RGBW color coordinate values and a W luminance output value.

Further, the first luminance calculation sub-unit 413 in the device for image conversion provided in the embodiment of the present disclosure is specifically configured to: when it is determined that the W luminance output value is located in the first region, set a G luminance output value in the color-cast-removed RGBW luminance output values as zero; when it is determined that the W luminance output value is located in the second region, set a B luminance output value in the color-cast-removed RGBW luminance output values as zero; when it is determined that the W luminance output value is located in the third region, set a R luminance output value in the color-cast-removed RGBW luminance output values as zero.

Further, the first luminance calculation sub-unit 413 in the device for image conversion provided in the embodiment of the present disclosure is specifically configured to when it is determined that the W luminance output value is located in the first region, calculate the color-cast-removed RGBW luminance output values by the following equations:

$$L_{b'} = \left[\frac{1}{y_w} - \left(\frac{x_w}{y_w} - \frac{x_{w'}}{y_{w'}}\right)\frac{y_{w'} - y_r + y_{w'}x_r - x_{w'}y_r}{(x_r y_{w'} - x_{w'} y_r)y_{w'}}\right] * K * L_w$$

$$L_{r'} = \frac{y_{w'} y_r}{y_{w'} - y_r}\left[\left(\frac{1}{y_w} - \frac{1}{y_{w'}}\right) -\right.$$

-continued $$\left(\frac{1}{y_b}-\frac{1}{y_{w'}}\right)\frac{\left(\frac{x_w}{y_w}-\frac{x_{w'}}{y_{w'}}\right)-\frac{\left(\frac{x_r}{y_r}-\frac{x_{w'}}{y_{w'}}\right)\left(1-\frac{y_w}{y_{w'}}\right)}{\frac{y_w}{y_r}-\frac{y_w}{y_{w'}}}}{\frac{x_b}{y_b}-\frac{x_{w'}}{y_{w'}}-\frac{y_{w'}y_r}{y_{w'}-y_r}*\left(\frac{1}{y_b}-\frac{1}{y_{w'}}\right)\left(\frac{x_r}{y_r}-\frac{x_{w'}}{y_{w'}}\right)}\Bigg]*K*L_w$$

$$L_{w'}=K*(L_w-L_{b'}-L_{r'})$$

$$L_{g'}=0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

Further, the first luminance calculation sub-unit 413 in the device for image conversion provided in the embodiment of the present disclosure is specifically configured to when it is determined that the W luminance output value is located in the second region, calculate the color-cast-removed RGBW luminance output values by the following equations:

$$L_{r'}=\left[\frac{1}{y_w}-\left(\frac{x_w}{y_w}-\frac{x_{w'}}{y_{w'}}\right)\frac{y_{w'}-y_g+y_{w'}x_g-x_{w'}y_g}{(x_gy_{w'}-x_{w'}y_g)y_{w'}}\right]*K*L_w$$

$$L_{g'}=\frac{y_{w'}y_g}{y_{w'}-y_g}\left[\left(\frac{1}{y_w}-\frac{1}{y_{w'}}\right)-\left(\frac{1}{y_r}-\frac{1}{y_{w'}}\right)\frac{\left(\frac{x_w}{y_w}-\frac{x_{w'}}{y_{w'}}\right)-\frac{\left(\frac{x_g}{y_g}-\frac{x_{w'}}{y_{w'}}\right)\left(1-\frac{y_w}{y_{w'}}\right)}{\frac{y_w}{y_g}-\frac{y_w}{y_{w'}}}}{\frac{x_r}{y_r}-\frac{x_{w'}}{y_{w'}}-\frac{y_{w'}y_g}{y_{w'}-y_g}*\left(\frac{1}{y_r}-\frac{1}{y_{w'}}\right)\left(\frac{x_g}{y_g}-\frac{x_{w'}}{y_{w'}}\right)}\right]*K*L_w$$

$$L_{w'}=K*(L_w-L_{r'}-L_{g'})$$

$$L_{b'}=0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

Further, the first luminance calculation sub-unit 413 in the device for image conversion provided in the embodiment of the present disclosure is specifically configured to when it is determined that the W luminance output value is located in the third region, calculate the color-cast-removed RGBW luminance output values by the following equations:

$$L_{b'}=\left[\frac{1}{y_w}-\left(\frac{x_w}{y_w}-\frac{x_{w'}}{y_{w'}}\right)\frac{y_{w'}-y_g+y_{w'}x_g-x_{w'}y_g}{(x_gy_{w'}-x_{w'}y_g)y_{w'}}\right]*K*L_w$$

$$L_{g'}=\frac{y_{w'}y_g}{y_{w'}-y_g}\left[\left(\frac{1}{y_w}-\frac{1}{y_{w'}}\right)-\left(\frac{1}{y_b}-\frac{1}{y_{w'}}\right)\frac{\left(\frac{x_w}{y_w}-\frac{x_{w'}}{y_{w'}}\right)-\frac{\left(\frac{x_g}{y_g}-\frac{x_{w'}}{y_{w'}}\right)\left(1-\frac{y_w}{y_{w'}}\right)}{\frac{y_w}{y_g}-\frac{y_w}{y_{w'}}}}{\frac{x_b}{y_b}-\frac{x_{w'}}{y_{w'}}-\frac{y_{w'}y_g}{y_{w'}-y_g}*\left(\frac{1}{y_b}-\frac{1}{y_{w'}}\right)\left(\frac{x_g}{y_g}-\frac{x_{w'}}{y_{w'}}\right)}\right]*K*L_w$$

$$L_{w'}=K*(L_w-L_{b'}-L_{g'})$$

$$L_{r'}=0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

Further, as shown in FIG. 11, the color cast removing unit 400 in the device for image conversion provided in the embodiment of the present disclosure specifically comprises: a second optical calculation sub-unit 421 configured to when it is determined that the color having monochromatic color cast among RGBW is R, determine, in the chromaticity diagram, RGBW color coordinate values to which the RGBW luminance output values correspond respectively and a R actual color coordinate value; a second region selecting sub-unit 422 configured to determine in the chromaticity diagram position relationship between the R actual color coordinate value and a fourth region, a fifth region, according to the RGBW color coordinate values and the R actual color coordinate value; the fourth region being a region divided by an intersection between BR and an extension line from G to W, and W and R; the fifth region being a region divided by an intersection between GR and an extension line from B to W, and W and R; a second luminance calculation sub-unit 423 configured to determine color-cast-removed RGBW luminance output values respectively, according to the determined position relationship, a preset luminance adjustment coefficient, the R actual color coordinate value, RGBW color coordinate values and a R luminance output value.

Further, the second luminance calculation sub-unit 423 in the device for image conversion provided in the embodiment of the present disclosure is specifically configured to: when it is determined that the R luminance output value is located in the fourth region, set a G luminance output value in the color-cast-removed RGBW luminance output values as zero; when it is determined that the R luminance output value is located in the second region, set a B luminance output value in the color-cast-removed RGBW luminance output values as zero.

Further, the second luminance calculation sub-unit 423 in the device for image conversion provided in the embodiment of the present disclosure is specifically configured to when it is determined that the R luminance output value is located in the fourth region, calculate the color-cast-removed RGBW luminance output values by the following equations:

$$L_{r'} = (L_{b'} + L_{w'} + L_r) * K$$

$$L_{b'} = \frac{y_b}{y_r} * \frac{(y_w - y_{r'})(x_r - x_{r'}) - y_w(y_r - y_{r'})(x_w - x_{r'})}{(y_w - y_{r'})(x_{r'} - x_b) - y_w(y_b - y_{r'})(x_{r'} - x_w)} * K * L_r$$

$$L_{w'} = \frac{y_w}{y_r} * \left[ \frac{y_{r'} - y_r}{y_w - y_{r'}} - \frac{y_b - y_{r'}}{y_w - y_{r'}} * \frac{(y_w - y_{r'})(x_r - x_{r'}) - y_w(y_r - y_{r'})(x_w - x_{r'})}{(y_w - y_{r'})(x_{r'} - x_b) - y_w(y_b - y_{r'})(x_{r'} - x_w)} \right] * K * L_r$$

$$L_{g'} = 0$$

where $L_{r'}$, $L_{g'}$, $L_{b'}$ and $L_{w'}$ represent the color-cast-removed RGBW luminance output values respectively; $L_r$ represents the R luminance output value; K represents the luminance adjustment coefficient; $(x_{r'}, y_{r'})$ represents the R actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

Further, the second luminance calculation sub-unit 423 in the device for image conversion provided in the embodiment of the present disclosure is specifically configured to when it is determined that the R luminance output value is located in the fifth region, calculate the color-cast-removed RGBW luminance output values by the following equations:

$$L_{r'} = (L_{g'} + L_{w'} + L_r) * K$$

$$L_{g'} = \frac{y_g}{y_r} * \frac{(y_w - y_{r'})(x_r - x_{r'}) - y_w(y_r - y_{r'})(x_w - x_{r'})}{(y_w - y_{r'})(x_{r'} - x_g) - y_w(y_g - y_{r'})(x_{r'} - x_w)} * K * L_r$$

$$L_{w'} = \frac{y_w}{y_r} * \left[ \frac{y_{r'} - y_r}{y_w - y_{r'}} - \frac{y_g - y_{r'}}{y_w - y_{r'}} * \frac{(y_w - y_{r'})(x_r - x_{r'}) - y_w(y_r - y_{r'})(x_w - x_{r'})}{(y_w - y_{r'})(x_{r'} - x_g) - y_w(y_g - y_{r'})(x_{r'} - x_w)} \right] * K * L_r$$

$$L_{b'} = 0$$

where $L_{r'}$, $L_{g'}$, $L_{b'}$ and $L_{w'}$ represent the color-cast-removed RGBW luminance output values respectively; $L_r$ represents the R luminance output value; K represents the luminance adjustment coefficient; $(x_{r'}, y_{r'})$ represents the R actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

Further, as shown in FIG. 11, the color cast removing unit 400 in the device for image conversion provided in the embodiment of the present disclosure specifically comprises: a third optical calculation sub-unit 431 configured to when it is determined that the color having monochromatic color cast among RGBW is G, determine, in the chromaticity diagram, RGBW color coordinate values to which the RGBW luminance output values correspond respectively and a G actual color coordinate value; a third region selecting sub-unit 432 configured to determine in the chromaticity diagram position relationship between the G actual color coordinate value and a sixth region, a seventh region, according to the RGBW color coordinate values and the G actual color coordinate value; the sixth region being a region divided by an intersection between BG and an extension line from R to W, and W and G; the seventh region being a region divided by an intersection between GR and an extension line from B to W, and W and G; a third luminance calculation sub-unit 433 configured to determine color-cast-removed RGBW luminance output values respectively, according to the determined position relationship, a preset luminance adjustment coefficient, the G actual color coordinate value, RGBW color coordinate values and a G luminance output value.

Further, the third luminance calculation sub-unit 433 in the device for image conversion provided in the embodiment of the present disclosure is specifically configured to: when it is determined that the G luminance output value is located in the sixth region, set a R luminance output value in the color-cast-removed RGBW luminance output values as zero; when it is determined that the G luminance output value is located in the seventh region, set a B luminance output value in the color-cast-removed RGBW luminance output values as zero.

Further, the third luminance calculation sub-unit 433 in the device for image conversion provided in the embodiment of the present disclosure is specifically configured to: when it is determined that the G luminance output value is located in the sixth region, calculate the color-cast-removed RGBW luminance output values by the following equations:

$$L_{g'} = (L_g + L_{w'} + L_{b'}) * K$$

$$L_{b'} = \frac{y_b}{y_g} * \frac{(y_w - y_{g'})(x_g - x_{g'}) - y_w(y_b - y_{g'})(x_w - x_{g'})}{(y_w - y_{g'})(x_{g'} - x_g) - y_w(y_g - y_{g'})(x_{g'} - x_w)} * K * L_g$$

$$L_{w'} = \frac{y_w}{y_g} * \left[ \frac{y_{g'} - y_b}{y_w - y_{g'}} - \frac{y_g - y_{g'}}{y_w - y_{g'}} * \frac{(y_w - y_{g'})(x_b - x_{g'}) - y_w(y_b - y_{g'})(x_w - x_{g'})}{(y_w - y_{g'})(x_{g'} - x_b) - y_w(y_g - y_{g'})(x_{g'} - x_w)} \right] * K * L_g$$

$$L_{r'} = 0$$

where $L_{r'}$, $L_{g'}$, $L_{b'}$ and $L_{w'}$ represent the color-cast-removed RGBW luminance output values respectively; $L_g$ represents the G luminance output value; K represents the luminance adjustment coefficient; $(x_{g'}, y_{g'})$ represents the G actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

Further, the third luminance calculation sub-unit 433 in the device for image conversion provided in the embodiment of the present disclosure is specifically configured to when it is determined that the G luminance output value is located in the seventh region, calculate the color-cast-removed RGBW luminance output values by the following equations:

$$L_{g'} = (L_g + L_{w'} + L_{r'}) * K$$

$$L_{r'} = \frac{y_r}{y_g} * \frac{(y_w - y_{g'})(x_g - x_{g'}) - y_w(y_r - y_{g'})(x_w - x_{g'})}{(y_w - y_{g'})(x_{g'} - x_g) - y_w(y_g - y_{g'})(x_{g'} - x_w)} * K * L_g$$

$$L_{w'} = \frac{y_w}{y_g} * \left[ \frac{y_{g'} - y_r}{y_w - y_{g'}} - \frac{y_g - y_{g'}}{y_w - y_{g'}} * \frac{(y_w - y_{g'})(x_r - x_{g'}) - y_w(y_r - y_{g'})(x_w - x_{g'})}{(y_w - y_{g'})(x_{g'} - x_b) - y_w(y_g - y_{g'})(x_{g'} - x_w)} \right] * K * L_g$$

$$L_{b'} = 0$$

where $L_{r'}$, $L_{g'}$, $L_{b'}$ and $L_{w'}$ represent the color-cast-removed RGBW luminance output values respectively; $L_g$ represents the G luminance output value; K represents the luminance adjustment coefficient; $(x_{g'}, y_{g'})$ represents the G actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

Further, as shown in FIG. 11, the color cast removing unit 400 in the device for image conversion provided in the embodiment of the present disclosure specifically comprises: a fourth optical calculation sub-unit 441 configured to when it is determined that the color having monochromatic color cast among RGBW is B, determine, in the chromaticity diagram, RGBW color coordinate values to which the RGBW luminance output values correspond respectively and a B actual color coordinate value; a fourth region selecting sub-unit 442 configured to determine in the chromaticity diagram position relationship between the B actual color coordinate value and an eighth region, a ninth region, according to the RGBW color coordinate values and the B actual color coordinate value; the eighth region being a region divided by an intersection between BG and an extension line from R to W, and W and B; the ninth region being a region divided by an intersection between BR and an extension line from G to W, and W and B; a fourth luminance calculation sub-unit 443 configured to determine color-cast-removed RGBW luminance output values respectively, according to the determined position relationship, a preset luminance adjustment coefficient, the B actual color coordinate value, RGBW color coordinate values and a B luminance output value.

Further, the fourth luminance calculation sub-unit 443 in the device for image conversion provided in the embodiment of the present disclosure is specifically configured to: when it is determined that the B luminance output value is located in the eighth region, set a R luminance output value in the color-cast-removed RGBW luminance output values as zero; when it is determined that the B luminance output value is located in the ninth region, set a G luminance output value in the color-cast-removed RGBW luminance output values as zero.

Further, the fourth luminance calculation sub-unit 443 in the device for image conversion provided in the embodiment of the present disclosure is specifically configured to: when it is determined that the B luminance output value is located in the eighth region, calculate the color-cast-removed RGBW luminance output values by the following equations:

$$L_{b'} = (L_b + L_{w'} + L_{g'}) * K$$

$$L_{g'} = \frac{y_g}{y_b} * \frac{(y_w - y_{g'})(x_g - x_{g'}) - y_w(y_g - y_{g'})(x_w - x_{g'})}{(y_w - y_{g'})(x_{g'} - x_g) - y_w(y_g - y_{g'})(x_{g'} - x_w)} * K * L_b$$

$$L_{w'} = \frac{y_w}{y_b} * \left[ \frac{y_{g'} - y_g}{y_w - y_{g'}} - \frac{y_g - y_{g'}}{y_w - y_{g'}} * \frac{\begin{array}{r}(y_w - y_{g'})(x_g - x_{g'}) - \\ y_w(y_g - y_{g'})(x_w - x_{g'}) \\ (y_w - y_{g'})(x_{g'} - x_b) - \\ y_w(y_g - y_{g'})(x_{g'} - x_w)\end{array}}{} \right] * K * L_b$$

$$L_{r'} = 0$$

where $L_{r'}$, $L_{g'}$, $L_{b'}$ and $L_{w'}$ represent the color-cast-removed RGBW luminance output values respectively; $L_b$ represents the B luminance output value; K represents the luminance adjustment coefficient; $(x_{b'}, y_{b'})$ represents the B actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

Further, the fourth luminance calculation sub-unit 443 in the device for image conversion provided in the embodiment of the present disclosure is specifically configured to: when it is determined that the B luminance output value is located in the ninth region, calculate the color-cast-removed RGBW luminance output values by the following equations:

$$L_{b'} = (L_b + L_w + L_r) * K$$

$$L_{r'} = \frac{y_r}{y_b} * \frac{(y_w - y_{b'})(x_r - x_{b'}) - y_w(y_r - y_{b'})(x_w - x_{b'})}{(y_w - y_{b'})(x_{b'} - x_r) - y_w(y_r - y_{b'})(x_{b'} - x_w)} * K * L_b$$

$$L_{w'} = \frac{y_w}{y_b} * \left[ \frac{y_{b'} - y_r}{y_w - y_{b'}} - \frac{y_r - y_{b'}}{y_w - y_{b'}} * \frac{\begin{array}{r}(y_w - y_{b'})(x_r - x_{b'}) - \\ y_w(y_r - y_{b'})(x_w - x_{b'}) \\ (y_w - y_{b'})(x_{b'} - x_g) - \\ y_w(y_r - y_{b'})(x_{b'} - x_w)\end{array}}{} \right] * K * L_b$$

$$L_{g'} = 0$$

where $L_{r'}$, $L_{g'}$, $L_{b'}$ and $L_{w'}$ represent the color-cast-removed RGBW luminance output values respectively; $L_b$ represents the B luminance output value; K represents the luminance adjustment coefficient; $(x_{b'}, y_{b'})$ represents the B actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

Through the above description of the implementations, those skilled in the art may clearly understand that the embodiments of the present disclosure can be implemented by hardware or by a general-purpose hardware platform together with software. Based on such understanding, the technical solutions provided by the embodiments of the present disclosure can be in the form of a software product which can be stored in a non-volatile storage medium (e.g., a CD-ROM, a flash disk, a mobile hard disk etc.) and includes several instructions to cause a computer (e.g., a PC, a server, a network device etc.) to execute the methods provided by embodiments of the present disclose for various application scenarios.

Those skilled in the art should understand the drawings are merely schematic diagrams of a preferable embodiment, and not all the modules and the procedures in the drawings are necessary for implementing the present disclosure.

Those skilled in the art can understand the modules in the device of embodiments of the present disclosure can be located in the device as described in the embodiments, or can be located in one or more devices different from the embodiments of the present disclosure when modified accordingly. The modules in embodiments of the present disclosure can be combined into one module, or can be further divided into multiple sub modules.

The index numbers of the embodiments are merely for facilitating description, and should not be interpreted to be representative for the preference order of the embodiments.

The method for image conversion from RGB signals into RGBW signals and device provided in the embodiments of the present disclosure, after converting the RGB luminance input values into RGBW luminance output values, determine color-cast-removed RGBW luminance output values respectively, according to a position relationship between RGBW color coordinate values to which the RGBW luminance output values correspond respectively and a predetermined actual color coordinate value of a color having monochromatic color cast among RGBW in a chromaticity diagram, and thereafter convert the color-cast-removed RGBW luminance output values into corresponding RGBW output signals respectively and output the same. By means of the above method provided in the present disclosure, a color having monochromatic shifting among RGBW can be compensated back to the expected RGBW color coordinates and luminance values, so the problems of color gamut deviation and color distortion caused by RGBW monochromatic color cast are eliminated, color gamut of the displayed image is more accurate. Meanwhile, in the process of removing color cast, numerical value of the RGBW luminance output values can be adjusted as needed to improve luminance of a display device in entirety, thus improving image contrast.

Obviously, those skilled in the art can make various modifications and variations to the present disclosure without departing from the spirit and scope thereof. Thus, if such modifications and variations belong to the scope of the claims of the present disclosure and their equivalents, the present disclosure is also intended to include such modifications and variations.

The present disclosure claims the priority of Chinese patent application No. 201410291286.3 filed on Jun. 25, 2014, the content of which is incorporated herein as a whole as a portion of the present application.

What is claimed is:

1. A method for image conversion from RGB signals into RGBW signals, comprising:

converting received RGB input signals into corresponding RGB luminance input values, respectively;

converting the RGB luminance input values into RGBW luminance output values;

determining color-cast-removed RGBW luminance output values respectively, according to a position relationship between RGBW color coordinate values to which the RGBW luminance output values correspond respectively and a predetermined actual color coordinate value of a color having monochromatic color cast among RGBW in a chromaticity diagram;

converting the color-cast-removed RGBW luminance output values into corresponding RGBW output signals respectively and outputting the same, wherein determining color-cast-removed RGBW luminance output values respectively, according to the position relationship between RGBW color coordinate values to which the RGBW luminance output values correspond respectively and the predetermined actual color coordinate value of the color having monochromatic color cast among RGBW in the chromaticity diagram further comprises:

when it is determined that the color having monochromatic color cast among RGBW is W, determining, in the chromaticity diagram, RGBW color coordinate values to which the RGBW luminance output values correspond respectively and a W actual color coordinate value;

determining, in the chromaticity diagram, position relationship between the W actual color coordinate value and a first region, a second region, a third region, according to the RGBW color coordinate values and the W actual color coordinate value; the first region being a region divided by an intersection between BG and an extension line from R to W, an intersection between RG and an extension line from B to W, and W and G; the second region being a region divided by an intersection between BR and an extension line from G to W, an intersection between BG and an extension line from R to W, and W and B; the third region being a region divided by an intersection between RG and an extension line from B to W, an intersection between RB and an extension line from G to W, and W and R;

determining color-cast-removed RGBW luminance output values respectively, according to the determined position relationship, a preset luminance adjustment coefficient, the W actual color coordinate value, RGBW color coordinate values and a W luminance output value.

2. The method according to claim 1, wherein determining color-cast-removed RGBW luminance output values respectively, according to the determined position relationship, the preset luminance adjustment coefficient, the W actual color coordinate value, RGBW color coordinate values and the W luminance output value further comprises:

when it is determined that the W luminance output value is located in the first region, setting a G luminance output value in the color-cast-removed RGBW luminance output values as zero, and calculating the color-cast-removed RGBW luminance output values by the following equations:

$$L_{b'} = \left[\frac{1}{y_w} - \left(\frac{x_w}{y_w} - \frac{x_{w'}}{y_{w'}}\right)\frac{y_{w'} - y_r + y_{w'}x_r - x_{w'}y_r}{(x_r y_{w'} - x_{w'} y_r)y_{w'}}\right] * K * L_w$$

$$L_{r'} = \frac{y_{w'} y_r}{y_{w'} - y_r}\left[\left(\frac{1}{y_w} - \frac{1}{y_{w'}}\right) - \left(\frac{1}{y_b} - \frac{1}{y_{w'}}\right)\frac{\left(\frac{x_w}{y_w} - \frac{x_{w'}}{y_{w'}}\right) - \frac{\left(\frac{x_r}{y_r} - \frac{x_{w'}}{y_{w'}}\right)\left(1 - \frac{y_w}{y_{w'}}\right)}{\frac{y_w}{y_r} - \frac{y_w}{y_{w'}}}}{\frac{x_b}{y_b} - \frac{x_{w'}}{y_{w'}} - \frac{y_{w'} y_r}{y_{w'} - y_r} * \left(\frac{1}{y_b} - \frac{1}{y_{w'}}\right)\left(\frac{x_r}{y_r} - \frac{x_{w'}}{y_{w'}}\right)}\right] * K * L_w$$

$$L_{w'} = K * (L_w - L_{b'} - L_{r'})$$

$$L_{g'} = 0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively;

when it is determined that the W luminance output value is located in the second region, setting a B luminance output value in the color-cast-removed RGBW luminance output values as zero, andcalculating the color-cast-removed RGBW luminance output values by the following equations:

$$L_{r'} = \left[\frac{1}{y_w} - \left(\frac{x_w}{y_w} - \frac{x_{w'}}{y_{w'}}\right)\frac{y_{w'} - y_g + y_{w'}x_g - x_{w'}y_g}{(x_g y_{w'} - x_{w'} y_g)y_{w'}}\right] * K * L_w$$

-continued $$L_{g'} = \frac{y_{w'} y_g}{y_{w'} - y_g}\left[\left(\frac{1}{y_w} - \frac{1}{y_{w'}}\right) - \left(\frac{1}{y_b} - \frac{1}{y_{w'}}\right)\frac{\left(\frac{x_w}{y_w} - \frac{x_{w'}}{y_{w'}}\right) - \frac{\left(\frac{x_g}{y_g} - \frac{x_{w'}}{y_{w'}}\right)\left(1 - \frac{y_w}{y_{w'}}\right)}{\frac{y_w}{y_g} - \frac{y_w}{y_{w'}}}}{\frac{x_b}{y_b} - \frac{x_{w'}}{y_{w'}} - \frac{y_{w'} y_g}{y_{w'} - y_g} * \left(\frac{1}{y_b} - \frac{1}{y_{w'}}\right)\left(\frac{x_g}{y_g} - \frac{x_{w'}}{y_{w'}}\right)}\right] * K * L_w$$

$$L_{w'} = K * (L_w - L_{b'} - L_{g'})$$

$$L_{r'} = 0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively;

when it is determined that the W luminance output value is located in the third region, setting a R luminance output value in the color-cast-removed RGBW luminance output values as zero, and calculating the color-cast-removed RGBW luminance output values by the following equations:

$$L_{b'} = \left[\frac{1}{y_w} - \left(\frac{x_w}{y_w} - \frac{x_{w'}}{y_{w'}}\right)\frac{y_{w'} - y_g + y_{w'} x_g - x_{w'} y_g}{(x_g y_{w'} - x_{w'} y_g) y_{w'}}\right] * K * L_w$$

$$L_{g'} = \frac{y_{w'} y_g}{y_{w'} - y_g}\left[\left(\frac{1}{y_w} - \frac{1}{y_{w'}}\right) - \left(\frac{1}{y_b} - \frac{1}{y_{w'}}\right)\frac{\left(\frac{x_w}{y_w} - \frac{x_{w'}}{y_{w'}}\right) - \frac{\left(\frac{x_g}{y_g} - \frac{x_{w'}}{y_{w'}}\right)\left(1 - \frac{y_w}{y_{w'}}\right)}{\frac{y_w}{y_g} - \frac{y_w}{y_{w'}}}}{\frac{x_b}{y_b} - \frac{x_{w'}}{y_{w'}} - \frac{y_{w'} y_g}{y_{w'} - y_g} * \left(\frac{1}{y_b} - \frac{1}{y_{w'}}\right)\left(\frac{x_g}{y_g} - \frac{x_{w'}}{y_{w'}}\right)}\right] * K * L_w$$

$$L_{w'} = K * (L_w - L_{b'} - L_{g'})$$

$$L_{r'} = 0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

3. The method according to claim 1, wherein determining color-cast-removed RGBW luminance output values respectively, according to the position relationship between RGBW color coordinate values to which the RGBW luminance output values correspond respectively and the predetermined actual color coordinate value of the color having monochromatic color cast among RGBW in the chromaticity diagram further comprises:

when it is determined that the color having monochromatic color cast among RGBW is R, determining, in the chromaticity diagram, RGBW color coordinate values to which the RGBW luminance output values correspond respectively and a R actual color coordinate value;

determining, in the chromaticity diagram, position relationship between the R actual color coordinate value and a fourth region, a fifth region, according to the RGBW color coordinate values and the R actual color coordinate value; the fourth region being a region divided by an intersection between BR and an extension line from G to W, and W and R; the fifth region being a region divided by an intersection between GR and an extension line from B to W, and W and R;

determining color-cast-removed RGBW luminance output values respectively, according to the determined position relationship, a preset luminance adjustment coefficient, the R actual color coordinate value, RGBW color coordinate values and a R luminance output value.

4. The method according to claim 3, wherein determining color-cast-removed RGBW luminance output values respectively, according to the determined position relationship, the preset luminance adjustment coefficient, the R actual color coordinate value, RGBW color coordinate values and the R luminance output value further comprises:

when it is determined that the R luminance output value is located in the fourth region, setting a G luminance output value in the color-cast-removed RGBW luminance output values as zero; and calculating the color-cast-removed RGBW luminance output values by the following equations:

$$L_{r'} = (L_{b'} + L_{w'} + L_r) * K$$

$$L_{b'} = \frac{y_b}{y_r} * \frac{(y_w - y_{r'})(x_r - x_{r'}) - y_w(y_r - y_{r'})(x_w - x_{r'})}{(y_w - y_{r'})(x_{r'} - x_b) - y_w(y_b - y_{r'})(x_{r'} - x_w)} * K * L_r$$

$$L_{w'} = \frac{y_w}{y_r} * \left[\frac{y_{r'} - y_r}{y_w - y_{r'}} - \frac{y_b - y_{r'}}{y_w - y_{r'}} * \frac{(y_w - y_{r'})(x_r - x_{r'}) - y_w(y_r - y_{r'})(x_w - x_{r'})}{(y_w - y_{r'})(x_{r'} - x_b) - y_w(y_b - y_{r'})(x_{r'} - x_w)}\right] * K * L_r$$

$$L_{g'} = 0$$

where $L_{r'}$, $L_{g'}$, $L_{b'}$ and $L_{w'}$ represent the color-cast-removed RGBW luminance output values respectively; $L_r$ represents the R luminance output value; K represents the luminance adjustment coefficient; $(x_{r'}, y_{r'})$ represents the R actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively;

when it is determined that the R luminance output value is located in the fifth region, setting a B luminance output value in the color-cast-removed RGBW luminance output values as zero, and calculating the color-cast-removed RGBW luminance output values by the following equations:

$$L_{r'} = (L_{g'} + L_{w'} + L_r) * K$$

$$L_{g'} = \frac{y_g}{y_r} * \frac{(y_w - y_{r'})(x_r - x_{r'}) - y_w(y_r - y_{r'})(x_w - x_{r'})}{(y_w - y_{r'})(x_{r'} - x_g) - y_w(y_g - y_{r'})(x_{r'} - x_w)} * K * L_r$$

$$L_{w'} = \frac{y_w}{y_r} * \left[ \frac{y_{r'} - y_r}{y_w - y_{r'}} - \frac{y_g - y_{r'}}{y_w - y_{r'}} * \frac{\begin{array}{r}(y_w - y_{r'})(x_r - x_{r'}) - \\ y_w(y_r - y_{r'})(x_w - x_{r'})\end{array}}{\begin{array}{r}(y_w - y_{r'})(x_{r'} - x_g) - \\ y_w(y_g - y_{r'})(x_{r'} - x_w)\end{array}} \right] * K * L_r$$

$$L_{b'} = 0$$

where $L_{r'}$, $L_{g'}$, $L_{b'}$ and $L_{w'}$ represent the color-cast-removed RGBW luminance output values respectively; $L_r$ represents the R luminance output value; K represents the luminance adjustment coefficient; $(x_{r'}, y_{r'})$ represents the R actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

5. The method according to claim 1, wherein determining color-cast-removed RGBW luminance output values respectively, according to the position relationship between RGBW color coordinate values to which the RGBW luminance output values correspond respectively and the predetermined actual color coordinate value of the color having monochromatic color cast among RGBW in the chromaticity diagram further comprises:

when it is determined that the color having monochromatic color cast among RGBW is G, determining, in the chromaticity diagram, RGBW color coordinate values to which the RGBW luminance output values correspond respectively and a G actual color coordinate value;

determining, in the chromaticity diagram, position relationship between the G actual color coordinate value and a sixth region, a seventh region, according to the RGBW color coordinate values and the G actual color coordinate value; the sixth region being a region divided by an intersection between BG and an extension line from R to W, and W and G; the seventh region being a region divided by an intersection between GR and an extension line from B to W, and W and G;

determining color-cast-removed RGBW luminance output values respectively, according to the determined position relationship, a preset luminance adjustment coefficient, the G actual color coordinate value, RGBW color coordinate values and a G luminance output value.

6. The method according to claim 5, wherein determining color-cast-removed RGBW luminance output values respectively, according to the determined position relationship, the preset luminance adjustment coefficient, the G actual color coordinate value, RGBW color coordinate values and the G luminance output value further comprises:

when it is determined that the G luminance output value is located in the sixth region, setting a R luminance output value in the color-cast-removed RGBW luminance output values as zero, and calculating the color-cast-removed RGBW luminance output values by the following equations:

$$L_{g'} = (L_g + L_{w'} + L_{b'}) * K$$

$$L_{b'} = \frac{y_b}{y_g} * \frac{(y_w - y_{g'})(x_g - x_{g'}) - y_w(y_b - y_{g'})(x_w - x_{g'})}{(y_w - y_{g'})(x_{g'} - x_g) - y_w(y_g - y_{g'})(x_{g'} - x_w)} * K * L_g$$

$$L_{w'} = \frac{y_w}{y_g} * \left[ \frac{y_{g'} - y_b}{y_w - y_{g'}} - \frac{y_g - y_{g'}}{y_w - y_{g'}} * \frac{\begin{array}{r}(y_w - y_{g'})(x_b - x_{g'}) - \\ y_w(y_b - y_{g'})(x_w - x_{g'})\end{array}}{\begin{array}{r}(y_w - y_{g'})(x_{g'} - x_b) - \\ y_w(y_g - y_{g'})(x_{g'} - x_w)\end{array}} \right] * K * L_g$$

$$L_{r'} = 0$$

where $L_{r'}$, $L_{g'}$, $L_{b'}$ and $L_{w'}$ represent the color-cast-removed RGBW luminance output values respectively; $L_g$ represents the G luminance output value; K represents the luminance adjustment coefficient; $(x_{g'}, y_{g'})$ represents the G actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively;

when it is determined that the G luminance output value is located in the seventh region, setting a B luminance output value in the color-cast-removed RGBW luminance output values as zero, andcalculating the color-cast-removed RGBW luminance output values by the following equations:

$$L_{g'} = (L_g + L_{w'} + L_{r'}) * K$$

$$L_{r'} = \frac{y_r}{y_g} * \frac{(y_w - y_{g'})(x_g - x_{g'}) - y_w(y_r - y_{g'})(x_w - x_{g'})}{(y_w - y_{g'})(x_{g'} - x_g) - y_w(y_g - y_{g'})(x_{g'} - x_w)} * K * L_g$$

$$L_{w'} = \frac{y_w}{y_g} * \left[ \frac{y_{g'} - y_r}{y_w - y_{g'}} - \frac{y_g - y_{g'}}{y_w - y_{g'}} * \frac{\begin{array}{r}(y_w - y_{g'})(x_r - x_{g'}) - \\ y_w(y_r - y_{g'})(x_w - x_{g'})\end{array}}{\begin{array}{r}(y_w - y_{g'})(x_{g'} - x_b) - \\ y_w(y_g - y_{g'})(x_{g'} - x_w)\end{array}} \right] * K * L_g$$

$$L_{b'} = 0$$

where $L_{r'}$, $L_{g'}$, $L_{b'}$ and $L_{w'}$ represent the color-cast-removed RGBW luminance output values respectively; $L_g$ represents the G luminance output value; K represents the luminance adjustment coefficient; $(x_{g'}, y_{g'})$ represents the G actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

7. The method according to claim 1, wherein determining color-cast-removed RGBW luminance output values respectively, according to the position relationship between RGBW color coordinate values to which the RGBW luminance output values correspond respectively and the predetermined actual color coordinate value of the color having monochromatic color cast among RGBW in the chromaticity diagram further comprises:

when it is determined that the color having monochromatic color cast among RGBW is B, determining, in the chromaticity diagram, RGBW color coordinate values to which the RGBW luminance output values correspond respectively and a B actual color coordinate value;

determining, in the chromaticity diagram, position relationship between the B actual color coordinate value and an eighth region, a ninth region, according to the RGBW color coordinate values and the B actual color coordinate value; the eighth region being a region divided by an intersection between BG and an extension line from R to W, and W and B; the ninth region being a region divided by an intersection between BR and an extension line from G to W, and W and B;

determining color-cast-removed RGBW luminance output values respectively, according to the determined position relationship, a preset luminance adjustment coefficient, the B actual color coordinate value, RGBW color coordinate values and a B luminance output value.

8. The method according to claim 7, wherein determining color-cast-removed RGBW luminance output values respectively, according to the determined position relationship, the preset luminance adjustment coefficient, the B actual color coordinate value, RGBW color coordinate values and the B luminance output value further comprises:

when it is determined that the B luminance output value is located in the eighth region, setting a R luminance output value in the color-cast-removed RGBW luminance output values as zero, and calculating the color-cast-removed RGBW luminance output values by the following equations:

$$L_{b'} = (L_b + L_{w'} + L_{g'}) * K$$

$$L_{g'} = \frac{y_g}{y_b} * \frac{(y_w - y_{g'})(x_g - x_{g'}) - y_w(y_g - y_{g'})(x_w - x_{g'})}{(y_w - y_{g'})(x_{g'} - x_g) - y_w(y_g - y_{g'})(x_{g'} - x_w)} * K * L_b$$

$$L_{w'} = \frac{y_w}{y_b} * \left[ \frac{y_{g'} - y_g}{y_w - y_{g'}} - \frac{y_g - y_{g'}}{y_w - y_{g'}} * \frac{\begin{array}{c}(y_w - y_{g'})(x_g - x_{g'}) - \\ y_w(y_g - y_{g'})(x_w - x_{g'})\end{array}}{\begin{array}{c}(y_w - y_{g'})(x_{g'} - x_b) - \\ y_w(y_g - y_{g'})(x_{g'} - x_w)\end{array}} \right] * K * L_b$$

$$L_{r'} = 0$$

where $L_{r'}$, $L_{g'}$, $L_{b'}$ and $L_{w'}$ represent the color-cast-removed RGBW luminance output values respectively; $L_b$ represents the B luminance output value; K represents the luminance adjustment coefficient; $(x_{b'}, y_{b'})$ represents the B actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively;

when it is determined that the B luminance output value is located in the ninth region, setting a G luminance output value in the color-cast-removed RGBW luminance output values as zero, and calculating the color-cast-removed RGBW luminance output values by the following equations:

$$L_{b'} = (L_b + L_w + L_r) * K$$

$$L_{r'} = \frac{y_r}{y_b} * \frac{(y_w - y_{b'})(x_r - x_{b'}) - y_w(y_r - y_{b'})(x_w - x_{b'})}{(y_w - y_{b'})(x_{b'} - x_r) - y_w(y_r - y_{b'})(x_{b'} - x_w)} * K * L_b$$

-continued $$L_{w'} = \frac{y_w}{y_b} * \left[ \frac{y_{b'} - y_r}{y_w - y_{b'}} - \frac{y_r - y_{b'}}{y_w - y_{b'}} * \frac{\begin{array}{c}(y_w - y_{b'})(x_r - x_{b'}) - \\ y_w(y_r - y_{b'})(x_w - x_{b'})\end{array}}{\begin{array}{c}(y_w - y_{b'})(x_{b'} - x_g) - \\ y_w(y_r - y_{b'})(x_{b'} - x_w)\end{array}} \right] * K * L_b$$

$$L_{g'} = 0$$

where $L_{r'}$, $L_{g'}$, $L_{b'}$ and $L_{w'}$ represent the color-cast-removed RGBW luminance output values respectively; $L_b$ represents the B luminance output value; K represents the luminance adjustment coefficient; $(x_{b'}, y_{b'})$ represents the B actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

9. A device for image conversion from RGB signals into RGBW signals, the device comprising a memory and a processor, the processor executes program codes stored in the memory to configure the device to:

receive RGB input signals;

convert the received RGB input signals into corresponding RGB luminance input values, respectively;

convert the RGB luminance input values into RGBW luminance output values;

determine color-cast-removed RGBW luminance output values respectively, according to a position relationship between RGBW color coordinate values to which the RGBW luminance output values correspond respectively and a predetermined actual color coordinate value of a color having monochromatic color cast among RGBW in a chromaticity diagram;

convert the color-cast-removed RGBW luminance output values into corresponding RGBW output signals;

output the RGBW output signals, wherein the device is further configured to:

when it is determined that the color having monochromatic color cast among RGBW is W, determine, in the chromaticity diagram, RGBW color coordinate values to which the RGBW luminance output values correspond respectively and a W actual color coordinate value;

determine in the chromaticity diagram position relationship between the W actual color coordinate value and a first region, a second region, a third region, according to the RGBW color coordinate values and the W actual color coordinate value; the first region being a region divided by an intersection between BG and an extension line from R to W, an intersection between RG and an extension line from B to W, and W and G; the second region being a region divided by an intersection between BR and an extension line from G to W, an intersection between BG and an extension line from R to W, and W and B; the third region being a region divided by an intersection between RG and an extension line from B to W, an intersection between RB and an extension line from G to W, and W and R;

determine color-cast-removed RGBW luminance output values respectively, according to the determined position relationship, a preset luminance adjustment coefficient, the W actual color coordinate value, RGBW color coordinate values and a W luminance output value.

10. The device for image conversion according to claim 9, wherein when it is determined that the W luminance output value is located in the first region, set a G luminance output value in the color-cast-removed RGBW luminance output values as zero, and calculate the color-cast-removed RGBW luminance output values by the following equations:

$$L_{b'} = \left[\frac{1}{y_w} - \left(\frac{x_w}{y_w} - \frac{x_{w'}}{y_{w'}}\right)\frac{y_{w'} - y_r + y_{w'}x_r - x_{w'}y_r}{(x_r y_{w'} - x_{w'} y_r)y_{w'}}\right] * K * L_w$$

$$L_{r'} = \frac{y_{w'} y_r}{y_{w'} - y_r}\left[\left(\frac{1}{y_w} - \frac{1}{y_{w'}}\right) - \left(\frac{1}{y_b} - \frac{1}{y_{w'}}\right)\frac{\left(\frac{x_w}{y_w} - \frac{x_{w'}}{y_{w'}}\right) - \frac{\left(\frac{x_r}{y_r} - \frac{x_{w'}}{y_{w'}}\right)\left(1 - \frac{y_w}{y_{w'}}\right)}{\frac{y_w}{y_r} - \frac{y_w}{y_{w'}}}}{\frac{x_b}{y_b} - \frac{x_{w'}}{y_{w'}} - \frac{y_{w'} y_r}{y_{w'} - y_r} * \left(\frac{1}{y_b} - \frac{1}{y_{w'}}\right)\left(\frac{x_r}{y_r} - \frac{x_{w'}}{y_{w'}}\right)}\right] * K * L_w$$

$$L_{w'} = K * (L_w - L_{b'} - L_{r'})$$

$$L_{g'} = 0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively;

when it is determined that the W luminance output value is located in the second region, set a B luminance output value in the color-cast-removed RGBW luminance output values as zero, and calculate the color-cast-removed RGBW luminance output values by the following equations:

$$L_{r'} = \left[\frac{1}{y_w} - \left(\frac{x_w}{y_w} - \frac{x_{w'}}{y_{w'}}\right)\frac{y_{w'} - y_g + y_{w'}x_g - x_{w'}y_g}{(x_g y_{w'} - x_{w'} y_g)y_{w'}}\right] * K * L_w$$

$$L_{g'} = \frac{y_{w'} y_g}{y_{w'} - y_g}\left[\left(\frac{1}{y_w} - \frac{1}{y_{w'}}\right) - \left(\frac{1}{y_r} - \frac{1}{y_{w'}}\right)\frac{\left(\frac{x_w}{y_w} - \frac{x_{w'}}{y_{w'}}\right) - \frac{\left(\frac{x_g}{y_g} - \frac{x_{w'}}{y_{w'}}\right)\left(1 - \frac{y_w}{y_{w'}}\right)}{\frac{y_w}{y_g} - \frac{y_w}{y_{w'}}}}{\frac{x_r}{y_r} - \frac{x_{w'}}{y_{w'}} - \frac{y_{w'} y_g}{y_{w'} - y_g} * \left(\frac{1}{y_r} - \frac{1}{y_{w'}}\right)\left(\frac{x_g}{y_g} - \frac{x_{w'}}{y_{w'}}\right)}\right] * K * L_w$$

$$L_{w'} = K * (L_w - L_{r'} - L_{g'})$$

$$L_{b'} = 0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively;

when it is determined that the W luminance output value is located in the third region, set a R luminance output value in the color-cast-removed RGBW luminance output values as zero calculate the color-cast-removed RGBW luminance output values by the following equations:

$$L_{b'} = \left[\frac{1}{y_w} - \left(\frac{x_w}{y_w} - \frac{x_{w'}}{y_{w'}}\right)\frac{y_{w'} - y_g + y_{w'}x_g - x_{w'}y_g}{(x_g y_{w'} - x_{w'} y_g)y_{w'}}\right] * K * L_w$$

$$L_{g'} = \frac{y_{w'} y_g}{y_{w'} - y_g}\left[\left(\frac{1}{y_w} - \frac{1}{y_{w'}}\right) - \left(\frac{1}{y_b} - \frac{1}{y_{w'}}\right)\frac{\left(\frac{x_w}{y_w} - \frac{x_{w'}}{y_{w'}}\right) - \frac{\left(\frac{x_g}{y_g} - \frac{x_{w'}}{y_{w'}}\right)\left(1 - \frac{y_w}{y_{w'}}\right)}{\frac{y_w}{y_g} - \frac{y_w}{y_{w'}}}}{\frac{x_b}{y_b} - \frac{x_{w'}}{y_{w'}} - \frac{y_{w'} y_g}{y_{w'} - y_g} * \left(\frac{1}{y_b} - \frac{1}{y_{w'}}\right)\left(\frac{x_g}{y_g} - \frac{x_{w'}}{y_{w'}}\right)}\right] * K * L_w$$

$$L_{w'} = K * (L_w - L_{b'} - L_{g'})$$

$$L_{r'} = 0$$

where $L_{r'}$, $L_{g'}$, $L_{b'}$ and $L_{w'}$ represent the color-cast-removed RGBW luminance output values respectively; $L_w$ represents the W luminance output value; K represents the luminance adjustment coefficient; $(x_{w'}, y_{w'})$ represents the W actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

11. The device for image conversion according to claim 9, wherein the device is further configured to:

when it is determined that the color having monochromatic color cast among RGBW is R, determine, in the chromaticity diagram, RGBW color coordinate values to which the RGBW luminance output values correspond respectively and a R actual color coordinate value;

determine in the chromaticity diagram position relationship between the R actual color coordinate value and a fourth region, a fifth region, according to the RGBW color coordinate values and the R actual color coordinate value; the fourth region being a region divided by an intersection between BR and an extension line from G to W, and W and R; the fifth region being a region divided by an intersection between GR and an extension line from B to W, and W and R;

determine color-cast-removed RGBW luminance output values respectively, according to the determined position relationship, a preset luminance adjustment coefficient, the R actual color coordinate value, RGBW color coordinate values and a R luminance output value.

12. The device for image conversion according to claim 11, wherein when it is determined that the R luminance output value is located in the fourth region, set a G luminance output value in the color-cast-removed RGBW luminance output values as zero, and calculate the color-cast-removed RGBW luminance output values by the following equations:

$$L_{r'} = (L_{b'} + L_{w'} + L_r) * K$$

$$L_{b'} = \frac{y_b}{y_r} * \frac{(y_w - y_{r'})(x_r - x_{r'}) - y_w(y_r - y_{r'})(x_w - x_{r'})}{(y_w - y_{r'})(x_{r'} - x_b) - y_w(y_b - y_{r'})(x_{r'} - x_w)} * K * L_r$$

$$L_{w'} = \frac{y_w}{y_r} * \left[ \frac{y_{r'} - y_r}{y_w - y_{r'}} - \frac{y_b - y_{r'}}{y_w - y_{r'}} * \frac{(y_w - y_{r'})(x_r - x_{r'}) - y_w(y_r - y_{r'})(x_w - x_{r'})}{(y_w - y_{r'})(x_{r'} - x_b) - y_w(y_b - y_{r'})(x_{r'} - x_w)} \right] * K * L_r$$

$$L_{g'} = 0$$

where $L_{r'}$, $L_{g'}$, $L_{b'}$ and $L_{w'}$ represent the color-cast-removed RGBW luminance output values respectively; $L_r$ represents the R luminance output value; K represents the luminance adjustment coefficient; $(x_{r'}, y_{r'})$ represents the R actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively;

when it is determined that the R luminance output value is located in the fifth region, set a B luminance output value in the color-cast-removed RGBW luminance output values as zero, and calculate the color-cast-removed RGBW luminance output values by the following equations:

$$L_{r'} = (L_{g'} + L_{w'} + L_r) * K$$

$$L_{g'} = \frac{y_g}{y_r} * \frac{(y_w - y_{r'})(x_r - x_{r'}) - y_w(y_r - y_{r'})(x_w - x_{r'})}{(y_w - y_{r'})(x_{r'} - x_g) - y_w(y_g - y_{r'})(x_{r'} - x_w)} * K * L_r$$

$$L_{w'} = \frac{y_w}{y_r} * \left[ \frac{y_{r'} - y_r}{y_w - y_{r'}} - \frac{y_g - y_{r'}}{y_w - y_{r'}} * \frac{(y_w - y_{r'})(x_r - x_{r'}) - y_w(y_r - y_{r'})(x_w - x_{r'})}{(y_w - y_{r'})(x_{r'} - x_g) - y_w(y_g - y_{r'})(x_{r'} - x_w)} \right] * K * L_r$$

$$L_{b'} = 0$$

where $L_{r'}$, $L_{g'}$, $L_{b'}$ and $L_{w'}$ represent the color-cast-removed RGBW luminance output values respectively; $L_r$ represents the R luminance output value; K represents the luminance adjustment coefficient; $(x_{r'}, y_{r'})$ represents the R actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

13. The device for image conversion according to claim 9, wherein the device is further configured to:

when it is determined that the color having monochromatic color cast among RGBW is G, determine, in the chromaticity diagram, RGBW color coordinate values to which the RGBW luminance output values correspond respectively and a G actual color coordinate value;

determine in the chromaticity diagram position relationship between the G actual color coordinate value and a sixth region, a seventh region, according to the RGBW color coordinate values and the G actual color coordinate value; the sixth region being a region divided by an intersection between BG and an extension line from R to W, and W and G; the seventh region being a region divided by an intersection between GR and an extension line from B to W, and W and G;

determine color-cast-removed RGBW luminance output values respectively, according to the determined position relationship, a preset luminance adjustment coefficient, the G actual color coordinate value, RGBW color coordinate values and a G luminance output value.

14. The device for image conversion according to claim 13, wherein when it is determined that the G luminance output value is located in the sixth region, set a R luminance output value in the color-cast-removed RGBW luminance output values as zero, and calculate the color-cast-removed RGBW luminance output values by the following equations:

$$L_{g'} = (L_g + L_{w'} + L_{b'}) * K$$

$$L_{b'} = \frac{y_b}{y_g} * \frac{(y_w - y_{g'})(x_g - x_{g'}) - y_w(y_b - y_{g'})(x_w - x_{g'})}{(y_w - y_{g'})(x_{g'} - x_g) - y_w(y_g - y_{g'})(x_{g'} - x_w)} * K * L_g$$

$$L_{w'} = \frac{y_w}{y_g} * \left[ \frac{y_{g'} - y_b}{y_w - y_{g'}} - \frac{y_g - y_{g'}}{y_w - y_{g'}} * \frac{(y_w - y_{g'})(x_b - x_{g'}) - y_w(y_b - y_{g'})(x_w - x_{g'})}{(y_w - y_{g'})(x_{g'} - x_b) - y_w(y_g - y_{g'})(x_{g'} - x_w)} \right] * K * L_g$$

$$L_{r'} = 0$$

where $L_{r'}$, $L_{g'}$, $L_{b'}$ and $L_{w'}$ represent the color-cast-removed RGBW luminance output values respectively; $L_g$ represents the G luminance output value; K represents the luminance adjustment coefficient; $(x_{g'}, y_{g'})$ represents the G actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively;

when it is determined that the G luminance output value is located in the seventh region, set a B luminance output value in the color-cast-removed RGBW luminance output values as zero, and calculate the color-cast-removed RGBW luminance output values by the following equations:

$$L_{g'} = (L_g + L_{w'} + L_{r'}) * K$$

$$L_{r'} = \frac{y_r}{y_g} * \frac{(y_w - y_{g'})(x_g - x_{g'}) - y_w(y_r - y_{g'})(x_w - x_{g'})}{(y_w - y_{g'})(x_{g'} - x_g) - y_w(y_g - y_{g'})(x_{g'} - x_w)} * K * L_g$$

$$L_{w'} = \frac{y_w}{y_g} * \left[ \frac{y_{g'} - y_r}{y_w - y_{g'}} - \frac{y_g - y_{g'}}{y_w - y_{g'}} * \frac{\begin{array}{c}(y_w - y_{g'})(x_r - x_{g'}) - \\ y_w(y_r - y_{g'})(x_w - x_{g'})\end{array}}{\begin{array}{c}(y_w - y_{g'})(x_{g'} - x_b) - \\ y_w(y_g - y_{g'})(x_{g'} - x_w)\end{array}} \right] * K * L_g$$

$$L_{b'} = 0$$

where $L_{r'}$, $L_{g'}$, $L_{b'}$ and $L_{w'}$ represent the color-cast-removed RGBW luminance output values respectively; $L_g$ represents the G luminance output value; K represents the luminance adjustment coefficient; $(x_{g'}, y_{g'})$ represents the G actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

15. The device for image conversion according to claim 9, wherein the device is further configured to:

when it is determined that the color having monochromatic color cast among RGBW is B, determine, in the chromaticity diagram, RGBW color coordinate values to which the RGBW luminance output values correspond respectively and a B actual color coordinate value;

determine in the chromaticity diagram position relationship between the B actual color coordinate value and an eighth region, a ninth region, according to the RGBW color coordinate values and the B actual color coordinate value; the eighth region being a region divided by an intersection between BG and an extension line from R to W, and W and B; the ninth region being a region divided by an intersection between BR and an extension line from G to W, and W and B;

determine color-cast-removed RGBW luminance output values respectively, according to the determined position relationship, a preset luminance adjustment coefficient, the B actual color coordinate value, RGBW color coordinate values and a B luminance output value.

16. The device for image conversion according to claim 15, wherein when it is determined that the B luminance output value is located in the eighth region, set a R luminance output value in the color-cast-removed RGBW luminance output values as zero, and calculate the color-cast-removed RGBW luminance output values by the following equations:

$$L_{b'} = (L_b + L_{w'} + L_{g'}) * K$$

$$L_{g'} = \frac{y_g}{y_b} * \frac{(y_w - y_{g'})(x_g - x_{g'}) - y_w(y_g - y_{g'})(x_w - x_{g'})}{(y_w - y_{g'})(x_{g'} - x_g) - y_w(y_g - y_{g'})(x_{g'} - x_w)} * K * L_b$$

$$L_{w'} = \frac{y_w}{y_b} * \left[ \frac{y_{g'} - y_g}{y_w - y_{g'}} - \frac{y_g - y_{g'}}{y_w - y_{g'}} * \frac{\begin{array}{c}(y_w - y_{g'})(x_g - x_{g'}) - \\ y_w(y_g - y_{g'})(x_w - x_{g'})\end{array}}{\begin{array}{c}(y_w - y_{g'})(x_{g'} - x_b) - \\ y_w(y_g - y_{g'})(x_{g'} - x_w)\end{array}} \right] * K * L_b$$

$$L_{r'} = 0$$

where $L_{r'}$, $L_{g'}$, $L_{b'}$ and $L_{w'}$ represent the color-cast-removed RGBW luminance output values respectively; $L_b$ represents the B luminance output value; K represents the luminance adjustment coefficient; $(x_{b'}, y_{b'})$ represents the B actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively;

when it is determined that the B luminance output value is located in the ninth region, set a G luminance output value in the color-cast-removed RGBW luminance output values as zero, and calculate the color-cast-removed RGBW luminance output values by the following equations:

$$L_{b'} = (L_b + L_w + L_r) * K$$

$$L_{r'} = \frac{y_r}{y_b} * \frac{(y_w - y_{b'})(x_r - x_{b'}) - y_w(y_r - y_{b'})(x_w - x_{b'})}{(y_w - y_{b'})(x_{b'} - x_r) - y_w(y_r - y_{b'})(x_{b'} - x_w)} * K * L_b$$

$$L_{w'} = \frac{y_w}{y_b} * \left[ \frac{y_{b'} - y_r}{y_w - y_{b'}} - \frac{y_r - y_{b'}}{y_w - y_{b'}} * \frac{\begin{array}{c}(y_w - y_{b'})(x_r - x_{b'}) - \\ y_w(y_r - y_{b'})(x_w - x_{b'})\end{array}}{\begin{array}{c}(y_w - y_{b'})(x_{b'} - x_g) - \\ y_w(y_r - y_{b'})(x_{b'} - x_w)\end{array}} \right] * K * L_b$$

$$L_{g'} = 0$$

where $L_{r'}$, $L_{g'}$, $L_{b'}$ and $L_{w'}$ represent the color-cast-removed RGBW luminance output values respectively; $L_b$ represents the B luminance output value; K represents the luminance adjustment coefficient; $(x_{b'}, y_{b'})$ represents the B actual color coordinate value in the chromaticity diagram, $(x_r, y_r)$, $(x_g, y_g)$, $(x_b, y_b)$ and $(x_w, y_w)$ represent RGBW color coordinate values in the chromaticity diagram, respectively.

* * * * *